US012611577B2

(12) United States Patent
Luttrell et al.

(10) Patent No.: US 12,611,577 B2
(45) **Date of Patent: *Apr. 28, 2026**

(54) GOLF CLUB HEAD

(71) Applicant: Acushnet Company, Fairhaven, MA (US)

(72) Inventors: Stephanie Luttrell, Carlsbad, CA (US); Richard Sanchez, Temecula, CA (US)

(73) Assignee: Acushnet Company, Fairhaven, MA (US)

( * ) Notice: Subject to any disclaimer, the term of this patent is extended or adjusted under 35 U.S.C. 154(b) by 1184 days.

This patent is subject to a terminal disclaimer.

(21) Appl. No.: 17/522,607

(22) Filed: Nov. 9, 2021

(65) Prior Publication Data

US 2023/0109616 A1 Apr. 6, 2023

Related U.S. Application Data

(63) Continuation-in-part of application No. 17/484,141, filed on Sep. 24, 2021, now Pat. No. 11,679,313.

(51) Int. Cl.
*A63B 53/04* (2015.01)

(52) U.S. Cl.
CPC ..... *A63B 53/0466* (2013.01); *A63B 53/0433* (2020.08); *A63B 53/045* (2020.08)

(58) Field of Classification Search
CPC ..... A63B 53/0466; A63B 53/045; A63B 53/0433
USPC ..... 473/345–346
See application file for complete search history.

(56) References Cited

U.S. PATENT DOCUMENTS

| | | | |
|---|---|---|---|
| 819,900 | A | 5/1906 | Martin |
| 1,091,231 | A | 3/1914 | Millar |
| 1,096,359 | A | 5/1914 | Dwight |
| 1,133,129 | A | 3/1915 | Govan |
| 1,167,106 | A | 1/1916 | Palmer |
| 1,167,387 | A | 1/1916 | Daniel |
| 1,322,182 | A | 11/1919 | Duncan |
| 1,396,470 | A | 11/1921 | Taylor |
| 1,436,579 | A | 11/1922 | Dayton |
| 1,467,435 | A | 9/1923 | Kinnear |
| 1,485,685 | A | 3/1924 | Alexander |

(Continued)

FOREIGN PATENT DOCUMENTS

| | | |
|---|---|---|
| GB | 2133295 | 7/1984 |
| JP | 01-91876 | 4/1989 |

(Continued)

OTHER PUBLICATIONS

English language translation of JP Patent Publication No. 2002-52099 (full text).

*Primary Examiner* — Sebastiano Passaniti
(74) *Attorney, Agent, or Firm* — Ryan A. Reis

(57) ABSTRACT

A golf club head, including a metallic body, a composite panel affixed to the metallic body, the composite panel having a substantially constant thickness, and a composite stiffening member affixed to the composite panel, the composite stiffening member extending into the interior cavity, wherein the composite stiffening member height is at least twice the composite stiffening member width and wherein the composite stiffening member length is at least five times the composite stiffening member height, wherein the composite panel comprises a thermoplastic composite.

17 Claims, 16 Drawing Sheets

(56) References Cited

U.S. PATENT DOCUMENTS 1,534,600 A 4/1925 Mattern
1,562,956 A 11/1925 Guerne
1,575,364 A 3/1926 Hodgkins
1,705,997 A 3/1929 Quynn
1,840,924 A 1/1932 Tucker
2,041,676 A 5/1936 Gallagher
2,214,356 A 9/1940 Wettlaufer
2,517,245 A 8/1950 Scott
2,652,256 A 9/1953 Thomas
2,750,194 A 6/1956 Clark
2,968,486 A 1/1961 Walton
3,064,980 A 11/1962 Steiner
3,084,940 A 4/1963 Cissel
3,166,320 A 1/1965 Onions
3,212,783 A 10/1965 Bradley et al.
3,220,733 A 11/1965 Saleeby
3,387,844 A 6/1968 Winsor
3,466,047 A 9/1969 Rodia et al.
3,556,532 A 1/1971 Ballmer
3,556,533 A 1/1971 Hollis
3,606,327 A 9/1971 Gorman
3,652,094 A 3/1972 Glover
3,692,306 A 9/1972 Glover
3,794,328 A 2/1974 Gordon
3,897,066 A 7/1975 Belmont
3,957,194 A 5/1976 Woodward
3,975,023 A 8/1976 Inamori
3,979,123 A 9/1976 Belmont
4,027,885 A 6/1977 Rogers
4,043,563 A 8/1977 Churchward
4,052,075 A 10/1977 Daly
4,085,934 A 4/1978 Churchward
4,139,196 A 2/1979 Riley
4,149,726 A 4/1979 Tredway, Sr.
4,195,842 A 4/1980 Coleman
4,220,276 A 9/1980 Weisert et al.
4,340,230 A 7/1982 Churchward
4,420,156 A 12/1983 Campau
4,423,874 A 1/1984 Stuff, Jr.
4,471,961 A 9/1984 Masghati et al.
4,489,945 A 12/1984 Kobayashi
4,508,350 A 4/1985 Duclos
4,512,583 A 4/1985 Leveque de Vilmorin
4,575,447 A 3/1986 Hariguchi
4,602,787 A 7/1986 Sugioka
4,603,808 A 8/1986 Stacher
4,604,319 A 8/1986 Evans
D285,473 S 9/1986 Flood
4,697,813 A 10/1987 Inoue
4,732,389 A 3/1988 Kobayashi
4,754,974 A 7/1988 Kobayashi
4,754,977 A 7/1988 Sahm
4,768,787 A * 9/1988 Shira ..... A63B 53/04 473/331
4,795,159 A 1/1989 Nagamoto
4,811,949 A 3/1989 Kobayashi
4,867,458 A 9/1989 Sumikawa et al.
4,869,507 A 9/1989 Sahm
4,895,371 A 1/1990 Bushner
4,944,515 A 7/1990 Shearer
4,988,104 A 1/1991 Shiotani
5,028,049 A 7/1991 McKeighen
5,042,806 A 8/1991 Helmstetter
5,050,879 A 9/1991 Sun et al.
5,064,197 A 11/1991 Eddy
5,076,585 A 12/1991 Bouquet
D323,035 S 1/1992 Yang
5,080,366 A * 1/1992 Okumoto ..... A63B 60/00 473/348
5,092,599 A 3/1992 Okumoto et al.
5,094,457 A 3/1992 Kinoshita
5,106,094 A 4/1992 Desbiolles
5,154,424 A 10/1992 Lo
5,176,383 A 1/1993 Duclos
5,193,810 A 3/1993 Antonious
5,205,560 A 4/1993 Hoshi et al.
5,213,328 A 5/1993 Long
5,221,086 A 6/1993 Antonious
5,228,615 A 7/1993 Iijima et al.
5,230,509 A 7/1993 Chavez
D344,118 S 2/1994 Lin
5,297,794 A 3/1994 Lu
5,299,807 A 4/1994 Hutin
5,316,305 A 5/1994 McCabe
5,346,216 A 9/1994 Aizawa
5,362,055 A 11/1994 Rennie
5,429,357 A 7/1995 Kobayashi
5,431,396 A 7/1995 Shieh
5,447,309 A 9/1995 Vincent
5,467,983 A 11/1995 Chen
D366,508 S 1/1996 Hutin
5,484,155 A 1/1996 Yamawaki et al.
5,492,327 A 2/1996 Biafore, Jr.
5,499,814 A 3/1996 Lu
5,511,786 A 4/1996 Antonious
5,518,243 A 5/1996 Redman
D372,512 S 8/1996 Simmons
5,547,427 A 8/1996 Rigal et al.
D375,130 S 10/1996 Hlinka et al.
5,570,886 A 11/1996 Rigal et al.
5,571,053 A 11/1996 Lane
5,584,770 A 12/1996 Jensen
5,586,948 A 12/1996 Mick
D377,509 S 1/1997 Katayama
D378,770 S 4/1997 Hlinka et al.
5,616,088 A 4/1997 Aizawa et al.
5,632,695 A 5/1997 Hlinka
5,643,108 A 7/1997 Cheng
D382,612 S 8/1997 Oyer
5,669,827 A 9/1997 Nagamoto
5,681,228 A 10/1997 Mikame et al.
5,718,641 A 2/1998 Lin
5,720,674 A 2/1998 Galy
D394,688 S 5/1998 Fox
5,772,527 A 6/1998 Liu
5,795,245 A 8/1998 Chang et al.
5,797,807 A 8/1998 Moore
D397,750 S 9/1998 Frazetta
5,803,830 A 9/1998 Austin et al.
RE35,955 E 11/1998 Lu
5,839,975 A 11/1998 Lundberg
D403,037 S 12/1998 Stone et al.
D405,488 S 2/1999 Burrows
5,888,148 A 3/1999 Allen
5,916,042 A 6/1999 Reimers
5,935,019 A 8/1999 Yamamoto
D413,952 S 9/1999 Oyer
5,947,840 A 9/1999 Ryan
5,967,905 A 10/1999 Nakahara et al.
5,971,867 A 10/1999 Galy
5,989,134 A 11/1999 Antonious
5,993,329 A 11/1999 Shieh
5,993,331 A 11/1999 Shieh
5,997,415 A 12/1999 Wood
6,017,280 A 1/2000 Hubert
6,033,319 A 3/2000 Farrar
6,042,486 A 3/2000 Gallagher
6,048,278 A 4/2000 Meyer et al.
6,056,649 A 5/2000 Imai
6,074,308 A 6/2000 Domas
6,074,310 A 6/2000 Ota
6,077,172 A 6/2000 Butler
6,086,485 A 7/2000 Hamada et al.
6,089,994 A 7/2000 Sun
6,120,389 A 9/2000 Kruse
6,123,627 A 9/2000 Antonious
D433,073 S 10/2000 Sodano
6,162,132 A 12/2000 Yoneyama
6,165,081 A 12/2000 Chou
6,183,377 B1 2/2001 Liang
6,183,381 B1 2/2001 Grant et al.
6,217,461 B1 4/2001 Galy
6,299,547 B1 10/2001 Kosmatka
6,319,149 B1 11/2001 Lee

(56) References Cited

U.S. PATENT DOCUMENTS 6,344,001 B1 2/2002 Hamada
6,348,013 B1 2/2002 Kosmatka
6,348,014 B1 2/2002 Chiu
6,354,961 B1 3/2002 Allen
6,354,962 B1 3/2002 Galloway
6,368,232 B1 4/2002 Hamada et al.
6,379,265 B1 4/2002 Hirakawa et al.
6,383,090 B1 5/2002 O'Doherty
6,390,932 B1 5/2002 Kosmatka et al.
6,409,612 B1 6/2002 Evans et al.
6,425,832 B2 7/2002 Cackett et al.
6,458,044 B1 10/2002 Vincent et al.
6,471,601 B1 10/2002 McCabe et al.
D465,251 S 11/2002 Wood et al.
6,491,592 B2 12/2002 Cackett et al.
6,506,129 B2 1/2003 Chen
6,524,194 B2 2/2003 McCabe
6,530,847 B1 3/2003 Antonious
6,558,271 B1 5/2003 Beach
6,558,272 B2 5/2003 Helmstetter et al.
6,595,871 B2 7/2003 Sano
6,602,149 B1 8/2003 Jacobson
6,607,452 B2 8/2003 Helmstetter et al.
6,612,938 B2 9/2003 Murphy
D482,089 S 11/2003 Burrows
D482,090 S 11/2003 Burrows
D482,420 S 11/2003 Burrows
D482,421 S 11/2003 Kessler
6,645,085 B2 11/2003 McCabe et al.
6,648,772 B2 11/2003 Vincent et al.
6,648,773 B1 11/2003 Evans
D484,208 S 12/2003 Burrows
6,663,506 B2 12/2003 Nishimoto
6,679,782 B2 1/2004 Tang et al.
6,679,786 B2 1/2004 McCabe
D486,542 S 2/2004 Burrows
6,695,715 B1 2/2004 Chikaraishi
6,716,110 B1 4/2004 Ballow
6,719,644 B2 4/2004 Beach
6,719,645 B2 4/2004 Kouno
6,739,984 B1 5/2004 Ciasullo
6,743,118 B1 6/2004 Soracco
6,773,360 B2 8/2004 Willett
6,783,465 B2 8/2004 Matsunaga
6,783,466 B2 8/2004 Seki et al.
6,811,496 B2 11/2004 Wahl et al.
D501,036 S 1/2005 Burrows
D501,235 S 1/2005 Imamoto
D501,523 S 2/2005 Dogan et al.
D501,903 S 2/2005 Tanaka
6,852,038 B2 2/2005 Yabu
6,855,068 B2 2/2005 Antonious
6,860,818 B2 3/2005 Mahaffey et al.
D504,478 S 4/2005 Burrows
6,875,129 B2 4/2005 Erickson et al.
6,878,073 B2 4/2005 Takeda
6,880,222 B2 4/2005 Matsunaga
6,881,158 B2 4/2005 Yang et al.
6,887,165 B2 5/2005 Tsurumaki
D506,236 S 6/2005 Evans et al.
D508,274 S 8/2005 Burrows
6,932,716 B2 8/2005 Ehlers et al.
6,955,612 B2 10/2005 Lu
6,979,270 B1 12/2005 Allen
D514,184 S 1/2006 Kawami
6,988,960 B2 1/2006 Mahaffey et al.
6,991,558 B2 1/2006 Beach et al.
D519,178 S 4/2006 Shimazaki
7,029,403 B2 4/2006 Rice et al.
D520,585 S 5/2006 Hasebe
D523,104 S 6/2006 Hasebe
7,056,228 B2 6/2006 Beach
D527,434 S 8/2006 Foster et al.
7,097,572 B2 8/2006 Yabu
7,097,573 B2 8/2006 Erickson et al.
7,108,614 B2 9/2006 Lo
7,121,956 B2 10/2006 Lo
7,137,905 B2 11/2006 Kohno
7,140,974 B2 11/2006 Chao et al.
7,140,977 B2 11/2006 Atkins, Sr.
7,153,220 B2 12/2006 Lo
7,156,750 B2 1/2007 Nishitani et al.
7,166,038 B2 1/2007 Williams
7,166,040 B2 1/2007 Hoffman et al.
7,166,041 B2 1/2007 Evans
7,169,060 B2 1/2007 Stevens et al.
D536,402 S 2/2007 Kawami
7,182,699 B2 2/2007 Matsunaga
7,186,190 B1 3/2007 Beach et al.
7,189,169 B2 3/2007 Billings
7,198,575 B2 4/2007 Beach et al.
7,204,768 B2 4/2007 Nakahara et al.
7,207,898 B2 4/2007 Rice et al.
7,211,006 B2 5/2007 Chang
7,223,180 B2 5/2007 Willett et al.
7,226,366 B2 6/2007 Galloway
7,241,230 B2 7/2007 Tsunoda et al.
7,258,626 B2 8/2007 Gibbs et al.
7,261,643 B2 8/2007 Rice et al.
7,273,423 B2 9/2007 Imamoto
D552,701 S 10/2007 Ruggiero et al.
7,294,064 B2 11/2007 Tsurumaki et al.
7,294,065 B2 11/2007 Liang et al.
7,318,782 B2 1/2008 Imamoto et al.
7,326,472 B2 2/2008 Shimazaki et al.
7,344,452 B2 3/2008 Imamoto et al.
7,347,795 B2 3/2008 Yamagishi et al.
7,347,796 B2 3/2008 Takeda
7,361,099 B2 4/2008 Rice et al.
7,367,899 B2 5/2008 Rice et al.
7,390,271 B2 6/2008 Yamamoto
7,396,293 B2 7/2008 Soracco
7,407,447 B2 8/2008 Beach
7,410,425 B2 8/2008 Willett et al.
7,410,426 B2 8/2008 Willett et al.
7,410,428 B1 8/2008 Dawson et al.
7,413,517 B2 8/2008 Butler, Jr. et al.
7,413,519 B1 8/2008 Dawson et al.
7,413,520 B1 8/2008 Hocknell
7,419,441 B2 9/2008 Hoffman
7,419,442 B1 9/2008 Alan et al.
7,431,666 B2 10/2008 Vincent et al.
7,431,667 B2 10/2008 Vincent et al.
7,438,649 B2 10/2008 Ezaki et al.
7,448,963 B2 11/2008 Beach et al.
7,452,285 B2 11/2008 Chao
7,470,201 B2 12/2008 Nakahara et al.
7,497,789 B2 3/2009 Burnett et al.
7,500,924 B2 3/2009 Yokota et al.
7,507,168 B2 * 3/2009 Chou ..... A63B 53/0466 473/348
7,510,485 B2 3/2009 Yamamoto
7,530,901 B2 5/2009 Imamoto et al.
7,530,903 B2 5/2009 Imamoto et al.
7,549,935 B2 6/2009 Foster et al.
7,556,567 B2 7/2009 Galloway
7,572,193 B2 8/2009 Yokota et al.
7,578,753 B2 8/2009 Beach et al.
7,582,024 B2 9/2009 Shear
7,585,233 B2 9/2009 Horacek et al.
7,604,548 B2 10/2009 Cole
7,607,992 B2 10/2009 Nishio
7,632,193 B2 12/2009 Thielen
7,632,195 B2 12/2009 Jorgensen
7,637,822 B2 12/2009 Foster et al.
7,670,235 B2 3/2010 Lo
7,682,264 B2 3/2010 Hsu et al.
7,717,804 B2 5/2010 Beach et al.
7,717,806 B2 5/2010 Kubota
D616,952 S 6/2010 Oldknow
7,749,097 B2 7/2010 Foster et al.
7,753,807 B2 7/2010 Nakano
7,758,452 B2 7/2010 Soracco
7,758,454 B2 7/2010 Burnett et al.

(56) References Cited

U.S. PATENT DOCUMENTS 7,771,290 B2 8/2010 Bezilla et al.
7,775,903 B2 8/2010 Kawaguchi et al.
7,775,905 B2 8/2010 Beach et al.
7,824,277 B2 11/2010 Bennett et al.
7,824,280 B2 11/2010 Yokota
7,854,665 B2 12/2010 Dewhurst
7,857,711 B2 12/2010 Shear
7,874,938 B2 1/2011 Chao
7,896,753 B2 3/2011 Boyd et al.
7,931,546 B2 4/2011 Bennett et al.
7,934,998 B2 5/2011 Yokota
7,967,700 B2 6/2011 Stites
8,007,369 B2 8/2011 Soracco
8,025,591 B2 9/2011 De La Cruz et al.
8,029,385 B2 * 10/2011 Horacek ..... A63B 53/0466 473/345
8,043,167 B2 10/2011 Boyd et al.
8,187,116 B2 5/2012 Boyd
8,206,241 B2 6/2012 Boyd et al.
8,226,500 B2 * 7/2012 Yamamoto ..... A63B 53/0466 473/332
8,235,841 B2 8/2012 Stites et al.
8,235,844 B2 8/2012 Albertsen et al.
8,241,143 B2 8/2012 Albertsen et al.
8,241,144 B2 8/2012 Albertsen et al.
8,267,808 B2 9/2012 De La Cruz et al.
8,328,659 B2 12/2012 Shear
8,403,771 B1 3/2013 Rice et al.
8,409,032 B2 4/2013 Myrhum et al.
8,419,569 B2 4/2013 Bennett et al.
8,425,348 B2 4/2013 Boyd et al.
8,425,349 B2 4/2013 Dawson
8,430,763 B2 4/2013 Beach et al.
8,435,134 B2 5/2013 Tang et al.
8,435,135 B2 5/2013 Stites et al.
8,435,137 B2 5/2013 Hirano
8,475,292 B2 7/2013 Rahrig
8,517,860 B2 8/2013 Albertsen et al.
8,529,368 B2 9/2013 Rice et al.
8,540,590 B2 9/2013 Tsukada
8,579,728 B2 11/2013 Morales et al.
8,591,351 B2 11/2013 Albertsen et al.
8,591,352 B2 11/2013 Hirano
8,602,912 B2 12/2013 Stites
8,632,419 B2 1/2014 Tang et al.
8,641,555 B2 2/2014 Stites et al.
8,651,975 B2 2/2014 Soracco
8,657,703 B2 * 2/2014 Wada ..... A63B 60/00 473/335
8,696,491 B1 4/2014 Myers
8,764,579 B2 * 7/2014 Ban ..... A63B 53/0466 473/332
8,777,778 B2 7/2014 Solheim
8,790,195 B1 7/2014 Myers
8,849,635 B2 9/2014 Hayase
8,858,363 B2 * 10/2014 Wada ..... A63B 60/00 473/335
8,951,143 B2 2/2015 Morales
8,979,671 B1 3/2015 DeMille
9,084,921 B1 7/2015 Liang et al.
9,138,619 B2 9/2015 Takechi
9,138,622 B1 * 9/2015 DeMille ..... A63B 60/00
9,174,103 B2 * 11/2015 Curtis ..... A63B 53/0466
9,205,311 B2 12/2015 Stokke
9,211,453 B1 12/2015 Foster
9,220,957 B1 12/2015 Myers
9,289,660 B1 3/2016 Myers
9,364,726 B2 6/2016 Sugimae
9,381,410 B2 7/2016 Golden
9,403,295 B2 8/2016 Sander
9,433,836 B2 9/2016 Breier
9,498,688 B2 11/2016 Galvan
9,517,394 B1 12/2016 Dacey
9,682,298 B1 6/2017 Kingston
9,694,254 B2 7/2017 Ashino
9,700,764 B2 7/2017 Carter
9,700,771 B2 7/2017 Murphy
9,731,175 B1 8/2017 Myers
9,802,084 B2 10/2017 Shimahara
9,821,201 B1 11/2017 Parsons
9,884,231 B2 2/2018 Hebreo
9,889,348 B2 * 2/2018 Motokawa ..... A63B 53/0466
10,065,084 B2 9/2018 Myrhum
10,076,694 B2 9/2018 Galvan
10,099,094 B2 10/2018 Myrhum
10,105,579 B1 10/2018 DeMille
10,195,498 B2 2/2019 Solheim
10,232,230 B2 3/2019 Takehara
10,245,479 B2 4/2019 Murphy
10,343,030 B2 7/2019 Funaki
10,376,757 B2 8/2019 Golden
10,406,414 B2 9/2019 Galvan
10,434,380 B2 10/2019 Kawaguchi
10,464,494 B2 11/2019 Chen
10,553,927 B2 2/2020 San Martin
10,569,143 B2 2/2020 Funaki
10,702,750 B1 * 7/2020 Wada ..... A63B 53/0466
10,716,974 B2 * 7/2020 Mizutani ..... A63B 53/04
10,940,371 B2 3/2021 Murphy
11,007,409 B2 5/2021 Kawaguchi
11,110,326 B2 9/2021 Mizutani
11,338,179 B2 * 5/2022 Takechi ..... A63B 53/0466
11,679,313 B2 * 6/2023 Luttrell ..... A63B 53/045 473/324
2002/0019265 A1 2/2002 Allen
2002/0055396 A1 5/2002 Nishimoto
2002/0137576 A1 9/2002 Dammen
2002/0160851 A1 10/2002 Liao
2002/0183134 A1 12/2002 Allen
2003/0148818 A1 8/2003 Myrhum et al.
2003/0220154 A1 11/2003 Anelli
2004/0033844 A1 2/2004 Chen
2004/0121853 A1 * 6/2004 Caldwell ..... A63B 60/00 473/345
2004/0176183 A1 9/2004 Tsurumaki
2004/0192463 A1 9/2004 Tsurumaki et al.
2004/0204265 A1 10/2004 Chang
2005/0009622 A1 1/2005 Antonious
2005/0026719 A1 2/2005 Yang
2005/0049081 A1 3/2005 Boone
2005/0075192 A1 4/2005 Han
2005/0096151 A1 5/2005 Hou et al.
2005/0143189 A1 6/2005 Lai
2005/0272523 A1 12/2005 Atkins, Sr.
2006/0052177 A1 3/2006 Nakahara et al.
2006/0052181 A1 3/2006 Serrano et al.
2006/0058112 A1 3/2006 Haralason et al.
2006/0089206 A1 4/2006 Lo
2006/0100029 A1 5/2006 Lo
2006/0122004 A1 6/2006 Chen
2006/0134408 A1 6/2006 Kaneko
2006/0148586 A1 7/2006 Williams et al.
2006/0148589 A1 7/2006 Liou
2006/0217216 A1 9/2006 Iizuka
2007/0026961 A1 2/2007 Hou
2007/0082751 A1 4/2007 Lo
2007/0155533 A1 7/2007 Solheim et al.
2007/0155534 A1 7/2007 Tsai et al.
2007/0207875 A1 9/2007 Kuan
2008/0132353 A1 6/2008 Hsiao
2009/0088270 A1 * 4/2009 Brekke ..... A63B 60/54 473/346
2009/0118034 A1 5/2009 Yokota
2010/0022327 A1 * 1/2010 Nakano ..... A63B 53/0466 473/349
2010/0029409 A1 2/2010 Noble
2010/0151964 A1 * 6/2010 Soracco ..... A63B 60/54 473/332
2010/0323812 A1 12/2010 Boyd
2010/0331103 A1 12/2010 Takahashi
2011/0151997 A1 6/2011 Shear
2011/0312437 A1 * 12/2011 Sargent ..... A63B 53/06 473/335

(56) References Cited

U.S. PATENT DOCUMENTS

| | | | | |
|---|---|---|---|---|
| 2011/0312440 | A1* | 12/2011 | Wada | A63B 53/0466 473/346 |
| 2011/0319188 | A1 | 12/2011 | Narita et al. | |
| 2012/0034991 | A1 | 2/2012 | Hartwell et al. | |
| 2012/0142447 | A1 | 6/2012 | Boyd et al. | |
| 2012/0142452 | A1 | 6/2012 | Burnett et al. | |
| 2012/0196701 | A1 | 8/2012 | Stites | |
| 2012/0202615 | A1 | 8/2012 | Beach et al. | |
| 2012/0244960 | A1 | 9/2012 | Tang et al. | |
| 2012/0270676 | A1 | 10/2012 | Burnett | |
| 2012/0277029 | A1 | 11/2012 | Albertsen | |
| 2012/0277030 | A1 | 11/2012 | Albertsen | |
| 2012/0289361 | A1 | 11/2012 | Beach et al. | |
| 2012/0302369 | A1* | 11/2012 | Ban | A63B 53/04 473/346 |
| 2013/0090185 | A1 | 4/2013 | Boyd et al. | |
| 2013/0119743 | A1* | 5/2013 | Evans | B29C 45/14786 297/452.18 |
| 2013/0130584 | A1 | 5/2013 | Fujiwara | |
| 2013/0165252 | A1 | 6/2013 | Rice et al. | |
| 2013/0165254 | A1 | 6/2013 | Rice et al. | |
| 2013/0184100 | A1 | 7/2013 | Burnett et al. | |
| 2013/0210542 | A1 | 8/2013 | Harbert et al. | |
| 2014/0038746 | A1 | 2/2014 | Beach et al. | |
| 2015/0094161 | A1* | 4/2015 | Stokke | A63B 53/0466 473/324 |
| 2015/0273289 | A1 | 10/2015 | Ashino | |
| 2015/0273290 | A1* | 10/2015 | Motokawa | A63B 53/0466 473/346 |
| 2015/0290503 | A1 | 10/2015 | Su | |
| 2015/0290504 | A1* | 10/2015 | Li | A63B 53/0466 156/60 |
| 2015/0360094 | A1 | 12/2015 | Deshmukh | |
| 2017/0136314 | A1 | 5/2017 | Myrhum | |
| 2020/0023246 | A1 | 1/2020 | Murphy | |
| 2020/0023247 | A1 | 1/2020 | Larsen | |
| 2020/0023248 | A1 | 1/2020 | Murphy | |
| 2021/0154539 | A1 | 5/2021 | Murphy | |

FOREIGN PATENT DOCUMENTS

| | | |
|---|---|---|
| JP | 01-259876 | 10/1989 |
| JP | 402063482 | 3/1990 |
| JP | 4-347179 | 12/1992 |
| JP | 7-155410 | 6/1995 |
| JP | 9-051968 | 2/1997 |
| JP | 9-215786 | 8/1997 |
| JP | 10137374 | 5/1998 |
| JP | 10234902 | 9/1998 |
| JP | 10248964 | 9/1998 |
| JP | 11-114107 | 4/1999 |
| JP | 11-114112 | 4/1999 |
| JP | 11-178955 | 7/1999 |
| JP | 11-319167 | 11/1999 |
| JP | 2000-126339 | 5/2000 |
| JP | 2000-176056 | 6/2000 |
| JP | 2000-176059 | 6/2000 |
| JP | 2000-262656 | 9/2000 |
| JP | 2001-000606 | 1/2001 |
| JP | 2001-149514 | 6/2001 |
| JP | 2001-190720 | 7/2001 |
| JP | 2002-011124 | 1/2002 |
| JP | 2002-52099 | 2/2002 |
| JP | 2003-93554 | 2/2003 |
| JP | 2003-62135 | 3/2003 |
| JP | 2003-190340 | 7/2003 |
| JP | 2003-265657 | 9/2003 |
| JP | 2003-290397 | 10/2003 |
| JP | 2003-325709 | 11/2003 |
| JP | 2004-121395 | 4/2004 |
| JP | 2004-174224 | 6/2004 |
| JP | 2004-261451 | 9/2004 |
| JP | 2004-313762 | 11/2004 |
| JP | 2004-351054 | 12/2004 |
| JP | 2004-351173 | 12/2004 |
| JP | 2005-000576 | 1/2005 |
| JP | 2005160947 | 6/2005 |
| JP | 2005-177092 | 7/2005 |
| JP | 2006-000435 | 1/2006 |
| JP | 2006-081862 | 3/2006 |
| JP | 2006-122334 | 5/2006 |
| JP | 2006-187489 | 7/2006 |
| JP | 2006-198251 | 8/2006 |
| JP | 2006-239154 | 9/2006 |
| JP | 2009-279373 | 12/2009 |
| WO | WO 2007-136069 | 6/2007 |

* cited by examiner

GOLF CLUB HEAD

RELATED APPLICATIONS

This application is a continuation-in-part of U.S. patent application Ser. No. 17/484,141, filed on Sep. 24, 2021, currently pending, which is hereby incorporated by reference in its entirety. To the extent appropriate, the present application claims priority to the above-referenced application.

TECHNICAL FIELD

This present technology generally relates to systems, devices, and methods related to golf clubs, and more specifically to new and improved metalwood golf clubs having a stiffening member.

DESCRIPTION OF THE RELATED TECHNOLOGY

The complexities of golf club design are well known. The specifications for each component of the club (i.e., the club head, shaft, grip, and subcomponents thereof) directly impact the performance of the club. Thus, by varying the design specifications, a golf club can be tailored to have specific performance characteristics.

The design of club heads has long been studied. Among the more prominent considerations in club head design are loft, lie, face angle, horizontal face bulge, vertical face roll, center of gravity (CG), inertia, material selection, and overall head weight. While this basic set of criteria is generally the focus of golf club engineering, several other design aspects must also be addressed. The interior design of the club head may be tailored to achieve particular characteristics, such as the inclusion of hosel or shaft attachment means, perimeter weights on the club head, and fillers within hollow club heads.

Golf club heads must also be strong to withstand the repeated impacts that occur during collisions between the golf club and the golf ball. The loading that occurs during this transient event can create a peak force of over 2,000 lbs. Thus, a major challenge is designing the club face and body to resist permanent deformation or failure by material yield or fracture.

Players generally seek a metal wood driver and golf ball combination that delivers maximum distance and landing accuracy. The distance a ball travels after impact is dictated by the magnitude and direction of the ball's translational velocity and the ball's rotational velocity or spin. Environmental conditions, including atmospheric pressure, humidity, temperature, and wind speed, further influence the ball's flight. However, these environmental effects are beyond the control of the golf equipment manufacturer. Golf ball landing accuracy is driven by a number of factors as well. Some of these factors are attributed to club head design, such as center of gravity and club face flexibility.

Technological breakthroughs in recent years provide the average golfer with more distance, such as making larger head clubs while keeping the weight constant or even lighter, by casting consistently thinner shell thickness and going to lighter materials such as titanium or composites.

However, despite the potential gains in the discretionary mass gained by the utilization of thinner constructions and lightweight materials, they usually comes with some drawbacks. More specifically, they may generally come with an undesirable acoustic characteristic at impact, making the golf club undesirable to a golfer irrespective of performance. U.S. Pat. No. 6,612,938 to Murphy et al. illustrates one of the earlier attempts to use exotic materials in a golf club head such as plies of pre-preg material. One method of improving the acoustic signature of the golf club head is to stiffen the club head using stiffening members, such as those disclosed in U.S. Pat. No. 9,498,688 to Galvan et al. U.S. Pat. No. 8,651,975 to Soracco provided another example of an attempt to address the acoustic characteristics associated with golf clubs that utilizes exotic material. More specifically, Soracco provided a golf club head with sound tuning composite members forming at least a portion of the surface of the golf club head. Finally, U.S. Pat. No. 8,849,635 to Hayase et al. went above and beyond the mere basic design of a golf club head for acoustic characteristics and even made an attempt to predict modal damping ratio of composite golf club heads.

Despite the above, none of the references provide a method to improve the performance of a golf club head by providing a way to improve the performance of a golf club head utilizing advanced materials all while providing a clean way to address the degradation of the acoustic characteristics of the golf club head. Hence, it can be seen from the above that a golf club design that is capable of achieving both of the goal of incorporating lightweight constructions in order to increase discretionary mass as well as achieving a desirable acoustic characteristic while minimizing the undesirable sound and feel of the golf club head. The present invention provides novel solutions for improving the stiffness and acoustic characteristics of a golf club head at impact.

SUMMARY

The systems, methods, and devices described herein have innovative aspects, no single one of which is indispensable or solely responsible for their desirable attributes. Without limiting the scope of the claims, some of the advantageous features will now be summarized.

The present invention relates to a golf club head including a stiffening member that alters the compliance characteristics as compared to known golf club heads.

One non-limiting embodiment of the present technology includes a golf club head, including a metallic body including a striking face, an aft portion extending aft from the striking face; the aft portion including: a sole defining a lower surface of the golf club head and extending aft from the striking face; a crown defining an upper surface of the golf club head and extending aft from the striking face; a skirt extending between the sole and the crown; a hosel extending from the crown; an interior cavity defined by the striking face, the sole, the crown, and the skirt; a composite panel affixed to the metallic body, the composite panel having a substantially constant thickness; and a composite stiffening member affixed to the composite panel, the composite stiffening member extending into the interior cavity; wherein the composite stiffening member comprises a composite stiffening member length measured along the major axis of the composite stiffening member, a composite stiffening member height measured perpendicularly to the composite stiffening member length and extending into the interior cavity, and a composite stiffening member width measured perpendicularly to the composite stiffening member length and the composite stiffening member height, wherein the composite stiffening member height is at least twice the composite stiffening member width and wherein the composite stiffening member length is at least five times the composite stiffening member height; wherein the composite panel comprises a thermoplastic composite.

In an additional non-limiting embodiment of the present technology the composite stiffening member comprises continuous carbon fibers running along its entire length.

In an additional non-limiting embodiment of the present technology the composite stiffening member is affixed to the metallic body.

In an additional non-limiting embodiment of the present technology the length of the composite stiffening member extends beyond the composite panel and the composite stiffening member is affixed to the metallic body at both a first end of the composite stiffening member and a second end of the composite stiffening member.

In an additional non-limiting embodiment of the present technology the metallic body comprises a shelf configured to receive the composite panel, and wherein the shelf comprises a shelf aperture, wherein the composite stiffening member resides within the shelf aperture.

In an additional non-limiting embodiment of the present technology the composite stiffening member is affixed to the metallic body.

An additional non-limiting embodiment of the present technology includes a method of constructing a golf club head, including: forming a substantially constant thickness composite body panel out of thermoplastic carbon composite; forming a composite stiffening member including a composite stiffening member length measured along the major axis of the composite stiffening member, a composite stiffening member height measured perpendicularly to the composite stiffening member length, and a composite stiffening member width measured perpendicularly to the composite stiffening member length and the composite stiffening member height, wherein the composite stiffening member height is at least twice the composite stiffening member width and wherein the composite stiffening member length is at least five times the composite stiffening member height; affixing the composite stiffening member to the composite body panel; affixing the composite body panel to a metallic body; wherein the metallic body comprises: a striking face, an aft portion extending aft from the striking face; the aft portion including: a sole defining a lower surface of the golf club head and extending aft from the striking face; a crown defining an upper surface of the golf club head and extending aft from the striking face; a skirt extending between the sole and the crown; a hosel extending from the crown; and an interior cavity defined by the striking face, the sole, the crown, and the skirt.

An additional non-limiting embodiment of the present technology includes affixing the composite stiffening member to the metallic body.

In an additional non-limiting embodiment of the present technology the metallic body comprises a shelf configure to receive the composite body panel, wherein the shelf comprises a shelf aperture configured to receive the composite stiffening member, and wherein the method of constructing a golf club head further comprises installing the composite stiffening member into the shelf aperture.

In an additional non-limiting embodiment of the present technology the composite stiffening member extends beyond the composite panel and the composite stiffening member is affixed to the metallic body at both a first end of the composite stiffening member and a second end of the composite stiffening member In an additional non-limiting embodiment of the present technology affixing the composite stiffening member to the composite body panel comprises diffusion bonding process the composite stiffening member to the composite body panel.

In an additional non-limiting embodiment of the present technology affixing the composite stiffening member to the composite body panel comprises a compression thermoforming process.

In an additional non-limiting embodiment of the present technology forming a composite stiffening member comprises laying continuous carbon fibers along the length of the composite stiffening member.

In an additional non-limiting embodiment of the present technology the composite body panel covers an aperture formed in the sole of the metallic body.

An additional non-limiting embodiment of the present technology includes a method of constructing a golf club head, including: forming a substantially constant thickness composite body panel; forming a composite stiffening member including a composite stiffening member length measured along the major axis of the composite stiffening member, a composite stiffening member height measured perpendicularly to the composite stiffening member length, and a composite stiffening member width measured perpendicularly to the composite stiffening member length and the composite stiffening member height, wherein the composite stiffening member height is at least twice the composite stiffening member width and wherein the composite stiffening member length is at least five times the composite stiffening member height; affixing the composite stiffening member to the composite body panel; affixing the composite body panel to a metallic body; wherein the metallic body comprises: a striking face, an aft portion extending aft from the striking face; the aft portion including: a sole defining a lower surface of the golf club head and extending aft from the striking face; a crown defining an upper surface of the golf club head and extending aft from the striking face; a skirt extending between the sole and the crown; a hosel extending from the crown; an interior cavity defined by the striking face, the sole, the crown, and the skirt; and a shelf configure to receive the composite body panel, wherein the shelf comprises a shelf aperture configured to receive the composite stiffening member; installing and affixing the composite stiffening member into the shelf aperture.

In an additional non-limiting embodiment of the present technology the composite body panel comprises a thermoplastic carbon composite In an additional non-limiting embodiment of the present technology affixing the composite stiffening member to the composite body panel comprises a diffusion bonding process.

In an additional non-limiting embodiment of the present technology affixing the composite stiffening member to the composite body panel comprises a compression thermoforming process.

In an additional non-limiting embodiment of the present technology forming a composite stiffening member comprises laying continuous carbon fibers along the length of the composite stiffening member.

In an additional non-limiting embodiment of the present technology wherein the composite body panel covers an aperture formed in the sole of the metallic body.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
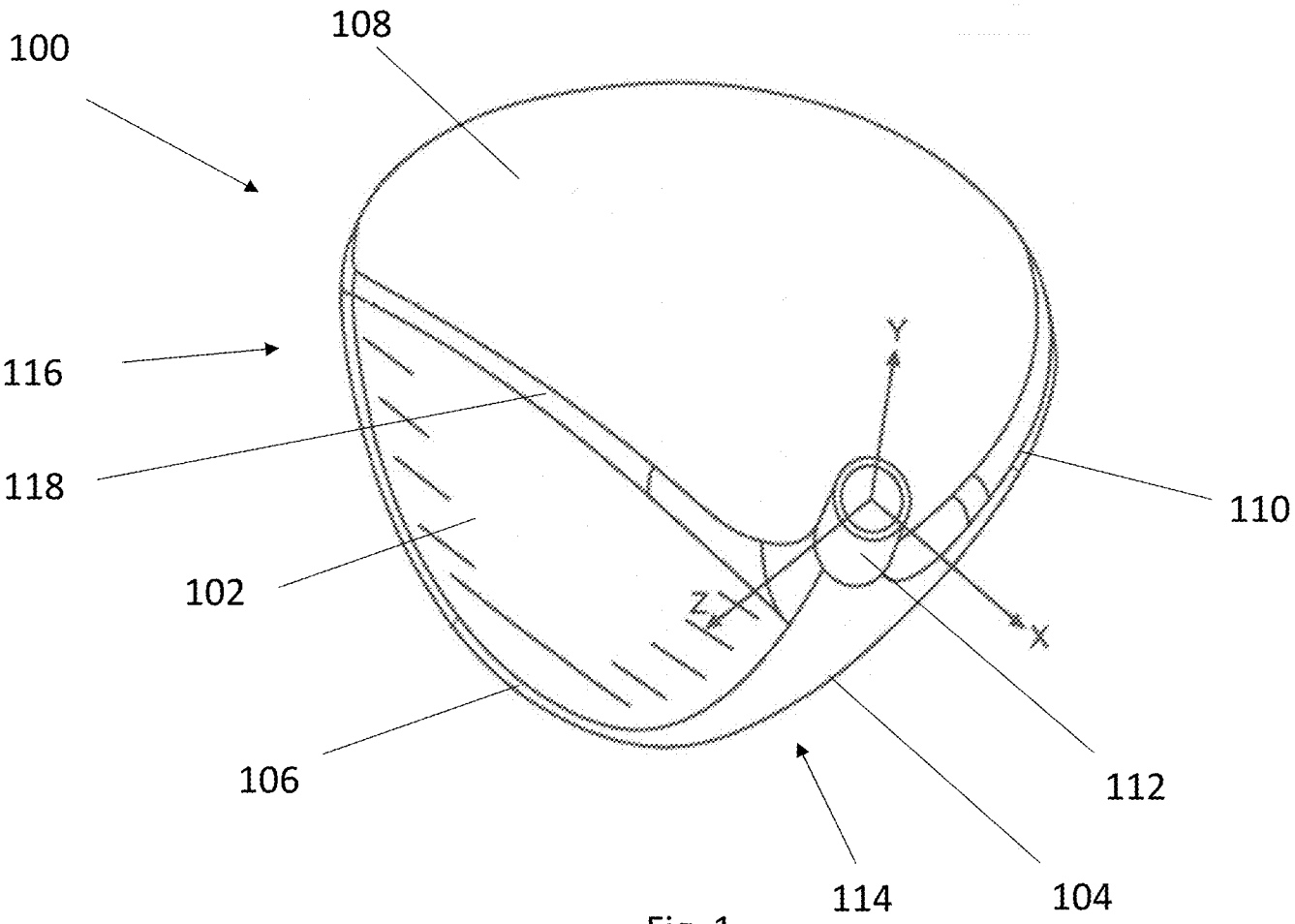
FIG. 1 illustrates a perspective view of a golf club head.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

FIG. 1 illustrates a perspective view of a golf club head 100 in accordance with the present invention. The golf club head 100 illustrated is a metal wood golf club head, and more specifically a driver with a volume of approximately 460 cc's. However, the inventions described herein can be applied to other metal wood golf club heads including fairways and hybrids. Additionally, the inventions described herein may further be included in iron type golf club heads as well. The golf club head 100 provides only a rough sketch of the external components of the golf club head 100 without illustrating the internal workings of the golf club head 100. More specifically, the golf club head 100 has a striking face 102 at a frontal portion of the golf club head 100, the striking face 102 configured to strike a golf ball (not illustrated). The golf club head also includes a sole 104 extending aft from a lower portion of the striking face 102. The intersection of the striking face 102 and the sole 104 forms the sole return 106. The golf club head 100 also includes a crown 108 extending aft from an upper portion of the striking face 102. The intersection of the striking face 102 and the crown 108 forms the crown return 118. The intersection of the sole 104 and the crown 108 forms a skirt 110 which extends around the aft perimeter of the golf club head 100. The golf club head 100 includes a hosel 112 extending out of the heel portion 114 of the club head 100, the hosel configured to receive a shaft (not illustrated), the heel portion being opposite the toe portion 116. FIG. 1 also includes a coordinate system wherein the z axis extends forward, parallel to a ground plane when the golf club head 100 is in an address position, an x axis perpendicular to the z-axis, and extending heelwards parallel to a ground plane when the gold club head 100 is in an address position, and substantially parallel to the striking face, and a y-axis perpendicular to the z-axis and x-axis.

Figure 2:
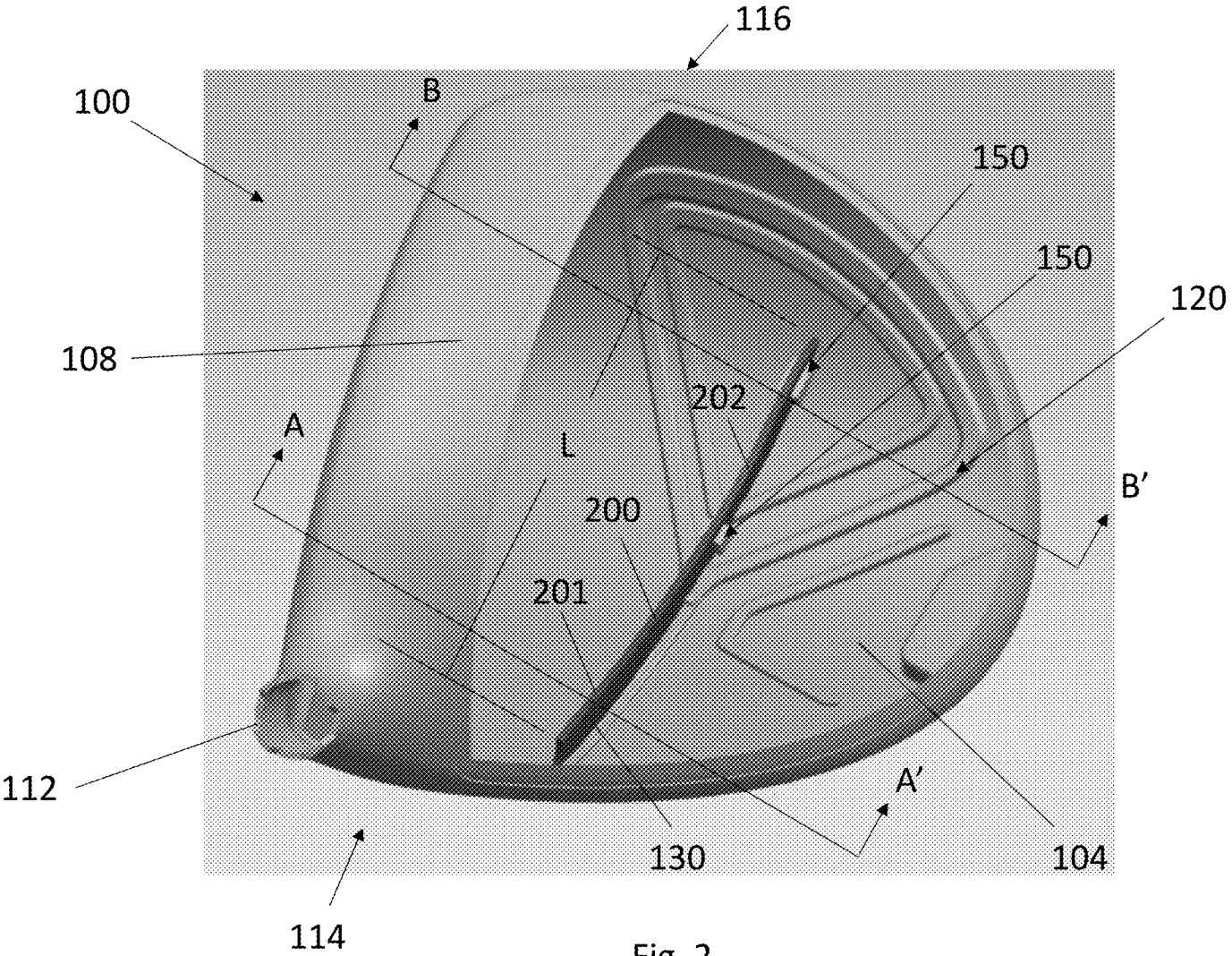
FIG. 2 illustrates an additional perspective view of the golf club head of FIG. 1 with a stiffening member and a portion of the crown missing for illustrative purposes.

FIG. 2 illustrates an additional perspective view of the golf club head 100 of FIG. 1 with a stiffening member and with a portion of the crown 108 missing for illustrative purposes. The interior 120 of the golf club head 100 is visible in FIG. 2. As illustrated in FIG. 2, the golf club head 100 also includes a stiffening member 200 affixed to the sole 104 of the golf club head 100. In the illustrated embodiment, a majority of the golf club head 100, including the sole 104, is formed from a metal material, and more specifically in the illustrated embodiment, titanium. In other embodiments, portions of the golf club head 100 may be formed of non-metal materials such as carbon fiber composites. In the illustrated embodiment, the stiffening member 200 is formed separately from the sole 104 and subsequently affixed to the sole 104.

The stiffening member 200 can be installed into the interior 120 in a variety of ways. In one embodiment, the golf club head 100 might have composite portions such as the crown which are affixed to the golf club head 100 after installation of the stiffening member 200, allowing the stiffening member 200 to be installed in interior of the golf club head 100 prior to final assembly of the golf club head 100.

Figure 3:
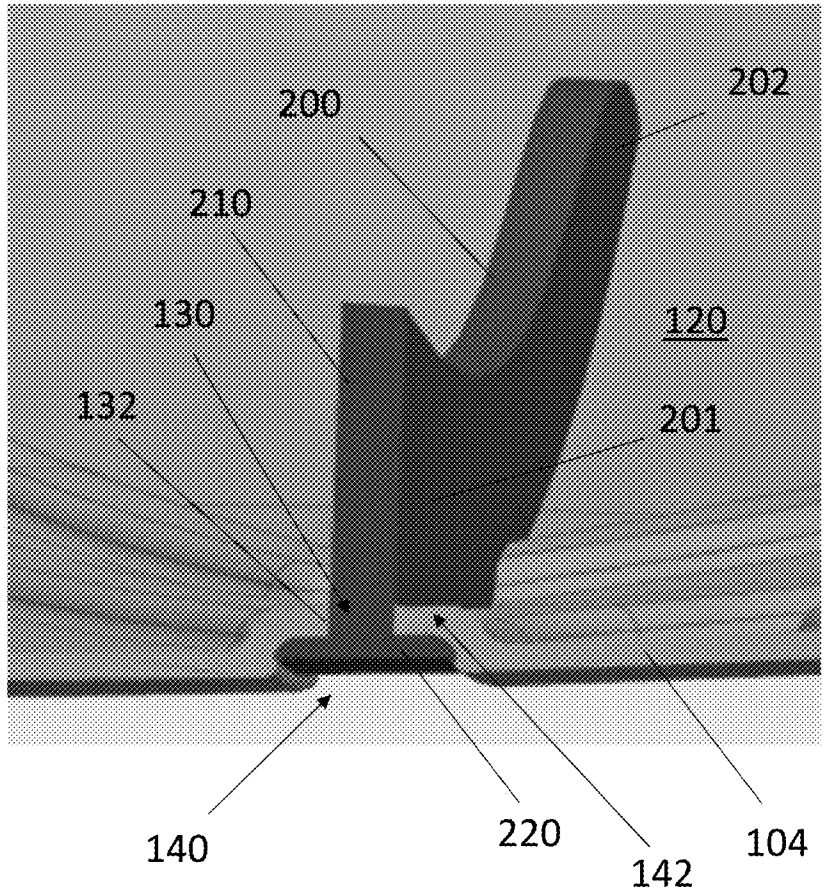
FIG. 3 illustrates a cross sectional view A-A' of the golf club head of FIG. 2.

FIG. 3 illustrates a cross sectional view A-A' of the golf club head of FIG. 2. In an additional embodiment, as illustrated in FIG. 3, the golf club head 100 can include an aperture 130 configured to receive the stiffening member. More specifically, the sole 104 can include the aperture 130. The stiffening member 200 can be installed through the aperture 130 and reside within the aperture 130 when it is affixed to the golf club head 100. The golf club head 100 can also include a recessed portion 140 to receive a portion of the stiffening member 200. The stiffening member 200 can include a internal portion 210 residing primarily within the interior 120 of the golf club head 100 and an external portion 220 residing primarily within the recessed portion 140 of the golf club head 100. In the illustrated embodiment, the external portion 220 is oriented substantially perpendicular to the internal portion 210. The recessed portion 140 includes a recessed wall 142. The aperture 130 is formed through the recessed wall 142. Additionally, the internal portion 210 of the stiffening member 200 abuts the recessed wall 142. In some embodiments, adhesive can be applied between the external portion 220 and the recessed wall 142. In some embodiments, adhesive can be applied between the stiffening member 200 and the edges 132 of the aperture 130. As illustrated, the recessed portion 140 can be configured such that the stiffening member 200 does not protrude past the outer extend of the sole 104.

Figure 4:
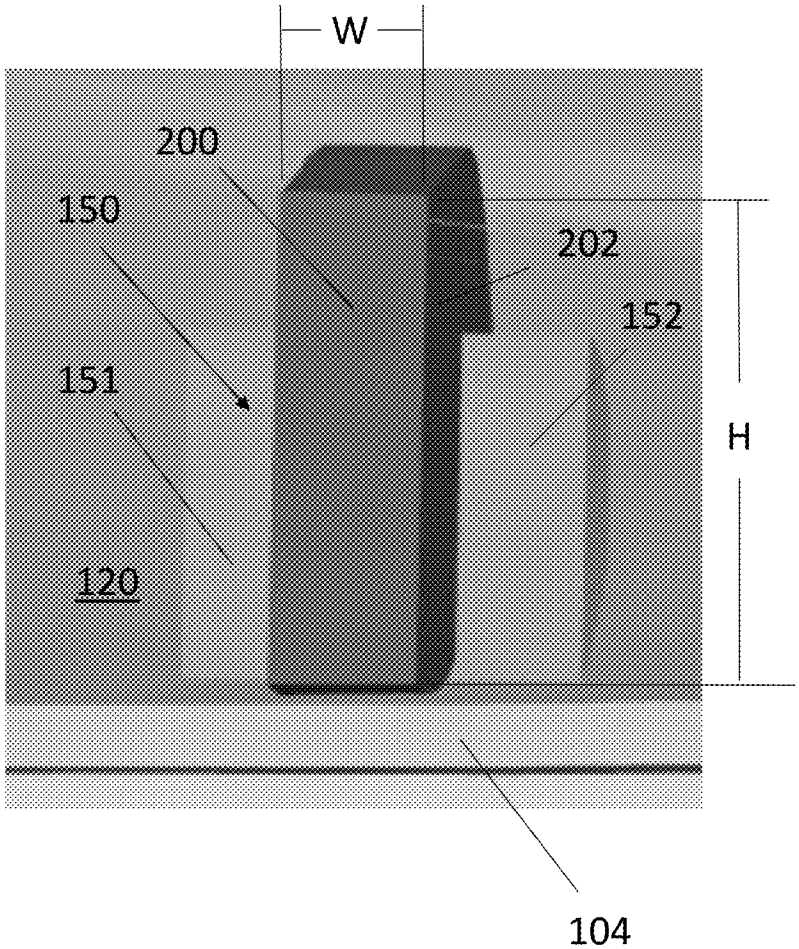
FIG. 4 illustrates a cross sectional view B-B' of the golf club head of FIG. 2.

FIG. 4 illustrates a cross sectional view B-B' of the golf club head of FIG. 2. In an additional embodiment, as illustrated in FIG. 4, the golf club head 100 can include one or more receptacles 150 in the interior 120 of the golf club head 100 configured to receive and retain the stiffening member 200. As illustrated in FIGS. 2 and 4, a receptacle 150 can include a first retention protrusion 151 and a second retention protrusion 152 configured to sandwich the stiffening member 200. In some embodiments, adhesive can be applied between the stiffening member 200 and the sole 104. In some embodiments, adhesive can be applied between the stiffening member and the retention protrusions 151, 152 of the receptacle 150. In other embodiments, no adhesive is applied between the stiffening member 200 and the receptacle 150. In other embodiments, the receptacle 150 only includes a single retention protrusion 151. In other embodiments, the first retention protrusion 151 can be offset lengthwise along the stiffening member 200 from the second retention protrusion 152.

Figure 5:
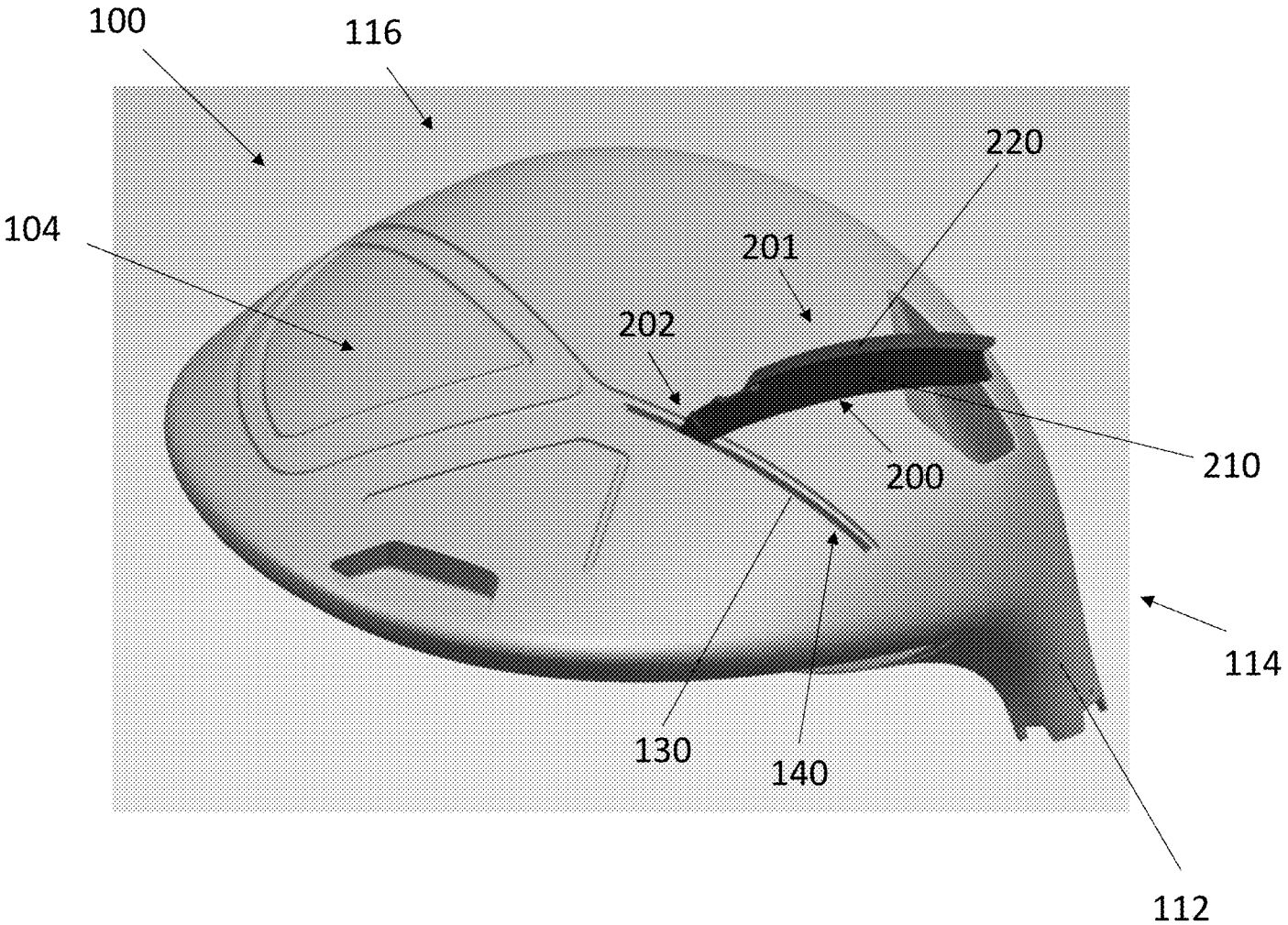
FIG. 5 illustrates a perspective view of the sole of golf club head of FIG. 1 including a partially installed stiffening member.

In some embodiments, as illustrated in FIGS. 2-4, the golf club head 100 can include an aperture 130, a recessed portion 140, and a receptacle 150 to retain a stiffening member. FIG. 5 illustrates a perspective view of the sole 104 of golf club head 100 of FIG. 1 including a partially installed stiffening member 200. The aperture 130 allows the stiffening member 200 to be installed from the exterior of the golf club head 100. As illustrated in FIGS. 2-5, the stiffening member can include a first portion 201 which includes an internal portion 210 and an external portion 220 and a second portion 202 which only includes an internal portion 210. The first portion 201 of the stiffening member 200 can have a length substantially similar to the length of the aperture 130 and recessed portion 140. As illustrated in FIG. 5, the stiffening member 200 can be rotated relative to its final mounting orientation and the second portion 202 of the stiffening member can be installed through the aperture 130 and then the stiffening member 200 can be rotated into its final mountain orientation such that the second portion 202 resides within the receptacle 150 and the external portion 220 of the first portion 201 resides within the recessed portion 140 as illustrated in FIGS. 2-4.

Figure 6:
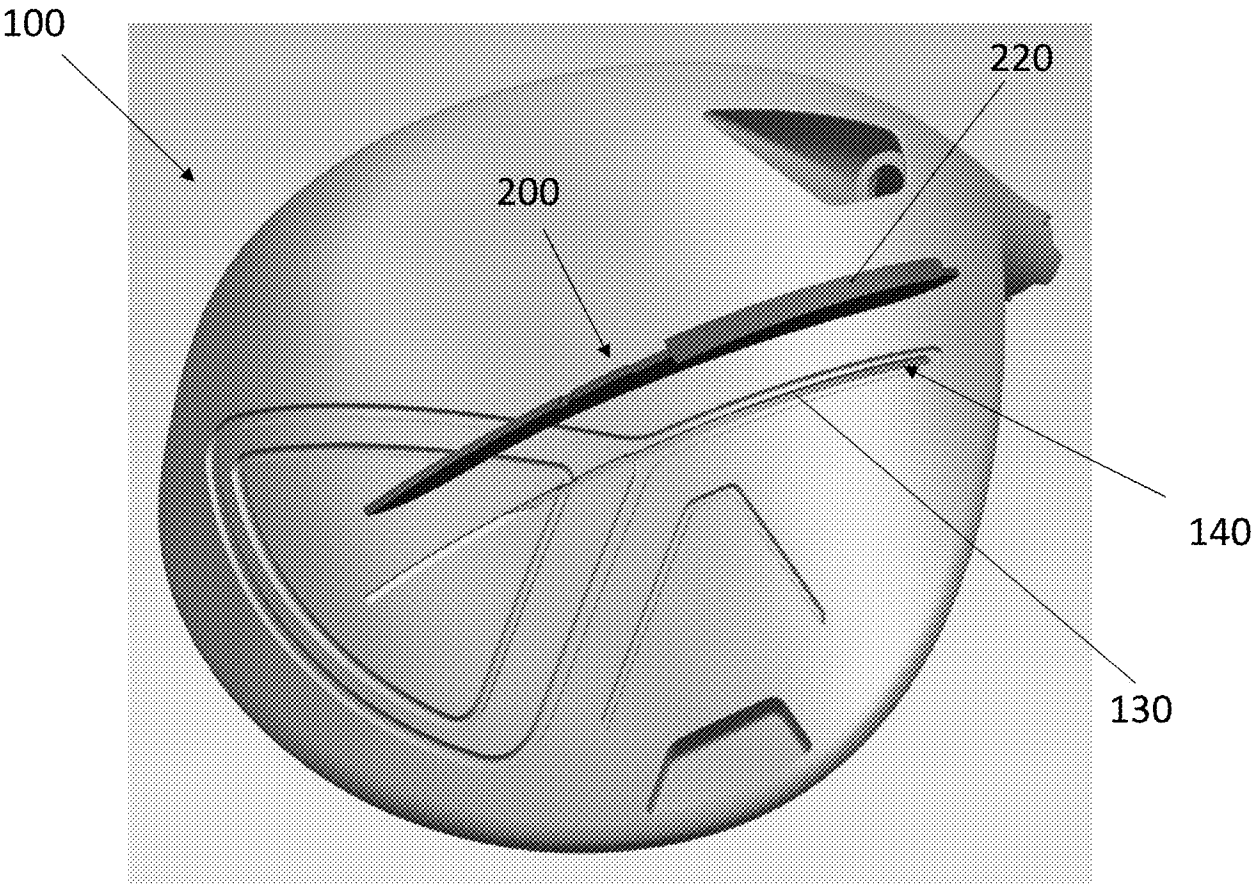
FIG. 6 illustrates an additional embodiment of the golf club head with the stiffening member not yet installed.

FIG. 6 illustrates an additional embodiment of the golf club head 100 with the stiffening member 200 not yet installed. As illustrated in FIG. 6, the aperture 130 can extend the full length of the stiffening member 200. In an additional embodiment, the recessed portion 140 could run the full length of the aperture 130 and the stiffening member 200 could include an external portion 220 which extends along the entire length of the stiffening member 200.

The stiffening member 200 illustrated in FIGS. 2-6 stiffens the sole 104 it is affixed to and improves the acoustic signature of the golf club head 100 at impact. Additionally, the external portion 220 of the stiffening member 200 can also provide a contrasting color on the exterior of the golf club head 100, improving the aesthetic of the golf club head 100 and providing visible technology for the golfer to enjoy. In one embodiment, the stiffening member 200 could be customized in color or possibly in pattern or text to designate different club characteristics to appeal to different groups or even individual golfers.

As illustrated in FIGS. 2 and 4 the stiffening member 200 has a length L measured along its major axis, a height H measured perpendicular to the length L extending into the interior 120 of the golf club head 100, and a width W measured perpendicularly to the height H and length L. In one embodiment the height H is at least twice the width W and the length L is at least 5 times the height H. In other embodiments, the stiffening member 200 can be affixed to other or additional portions of the golf club head such as the skirt, crown, striking face, hosel, etc. In one embodiment the width W of the stiffening member 200 is approximately 1.0 mm. In another embodiment the width W of the stiffening member 200 is approximately 1.4 mm.

As mentioned above, the stiffening member 200 can be adhered to the golf club head 100 utilizing adhesive. In other embodiments, the golf club head 100 and the stiffening member 200 can include complementary features such that the stiffening member 200 can snap into the golf club head 100 without the need for additional adhesives or mechanical locking features.

By manufacturing the stiffening member 200 separately from the rest of the golf club head 100 it can be made from different materials which may have higher stiffness properties and/or a lower density. The stiffening member 200 can be made from, for example, composite, carbon fiber infused polymer, thermoplastic, thermoplastic composite, titanium, steel, stainless steel, magnesium, ceramic, aluminum-boron carbide, boron carbide, aluminum, etc.

Stiffness of a material depends on its modulus of elasticity, also known as Young's modulus. It is preferable that the stiffening member 200 have a higher modulus of elasticity than the portion of the golf club head 100 it is affixed to, the sole 104 for example. It is also preferable for the stiffening member 200 to have a lower density than the portion of the golf club head 100 it is affixed to. Golf club head 100, for example, can be formed from titanium with a modulus of elasticity of approximately 113 GPa and a density of approximately 4.5 g/cm$^3$. The stiffening member 200, for example, can be formed from carbon fiber reinforced polymer with a modulus of elasticity of approximately 181 GPa and a density of approximately 1.5 g/cm$^3$. In one embodiment the stiffening member has a density of less than 4.0 g/cm$^3$. In one embodiment the stiffening member has a modulus of elasticity of greater than 120 GPa.

In one embodiment the stiffening member 200 has a modulus of elasticity at least 20% greater than the modulus of elasticity of the portion of the golf club head it is affixed to. In one embodiment the stiffening member 200 has a modulus of elasticity at least 30% greater than the modulus of elasticity of the portion of the golf club head it is affixed to. In one embodiment the stiffening member 200 has a modulus of elasticity at least 40% greater than the modulus of elasticity of the portion of the golf club head it is affixed to. In one embodiment the stiffening member 200 has a modulus of elasticity at least 50% greater than the modulus of elasticity of the portion of the golf club head it is affixed to.

In one embodiment the stiffening member 200 has a density that is at least 20% less than the density of the portion of the golf club head it is affixed to. In one embodiment the stiffening member 200 has a density that is at least 30% less than the density of the portion of the golf club head it is affixed to. In one embodiment the stiffening member 200 has a density that is at least 40% less than the density of the portion of the golf club head it is affixed to. In one embodiment the stiffening member 200 has a density that is at least 50% less than the density of the portion of the golf club head it is affixed to. In one embodiment the stiffening member 200 has a density that is at least 60% less than the density of the portion of the golf club head it is affixed to.

It is preferable for a composite stiffening member 200 to have the fibers aligned primarily in a lengthwise direction along its length to resist bending and provide stiffness to the golf club head. The modulus of the stiffening member 200 material should be taken of a sample with fibers oriented and loaded in a similar manner as it is in the golf club head 100.

Figure 7:
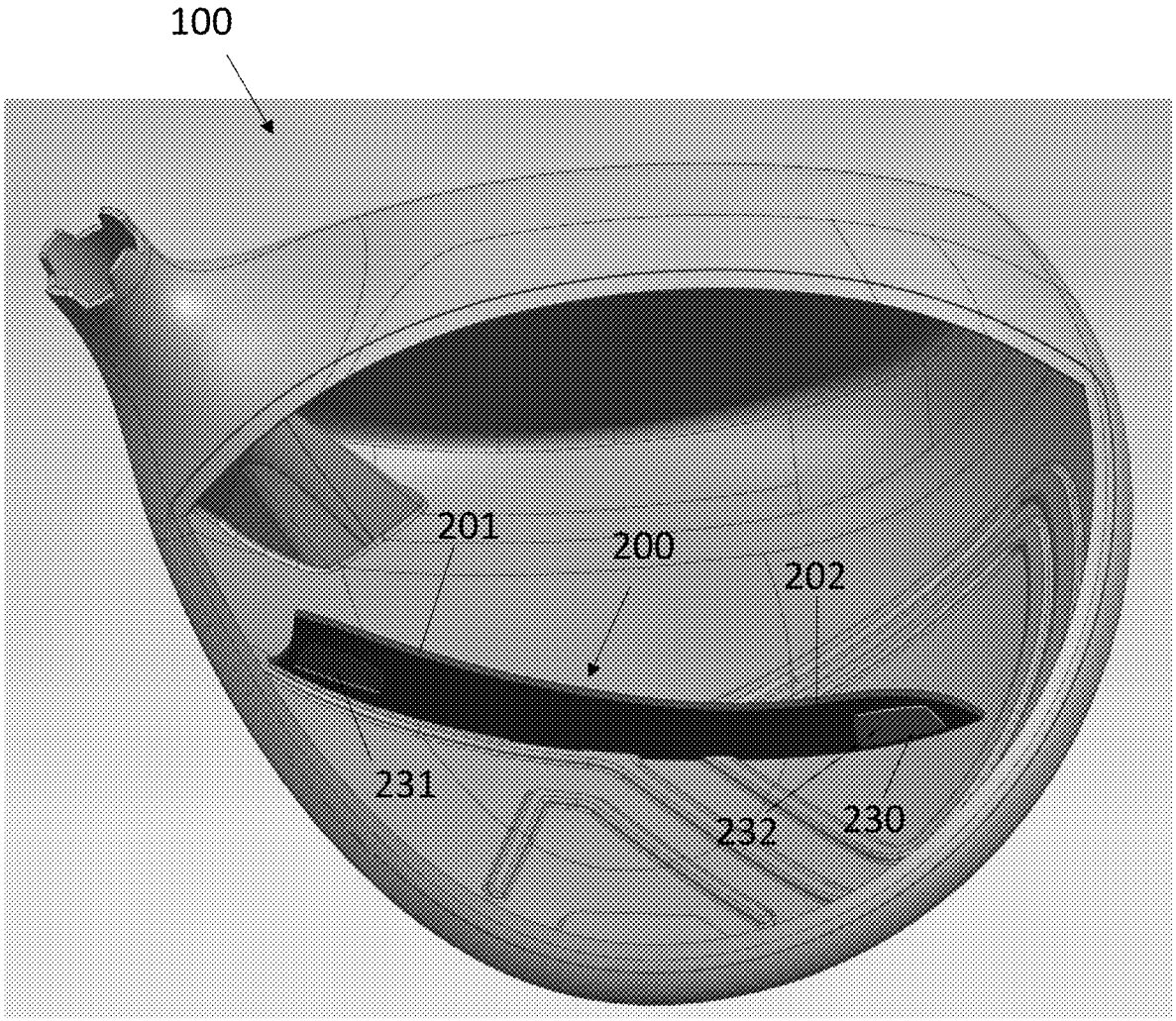
FIG. 7 illustrates an additional perspective view of a golf club head, with a portion of the crown missing for illustrative purposes, the golf club head including an additional embodiment of a stiffening member.

FIG. 7 illustrates an additional perspective view of a golf club head 100, with a portion of the crown missing for illustrative purposes, the golf club head 100 including an additional embodiment of a stiffening member 200. As illustrated in FIG. 7, the stiffening member 200 includes a first weight receptacle 231 in a first portion 201 of the stiffening member 200, a second weight receptacle 232 in a second portion 202 of the stiffening member 200, and a weight member 230 residing within the second weight receptacle 232. The weight member 230, first weight receptacle 231, and second weight receptacle 232 are configured such that the weight member 230 can be installed in either the first weight receptacle 231 or the second weight receptacle 232, altering the center of gravity location of the golf club head. In other embodiments, the golf club head 100 could include a plurality of stiffening members 200, further expanding the possibilities of adjusting the center of gravity location of the golf club head.

Figure 8:
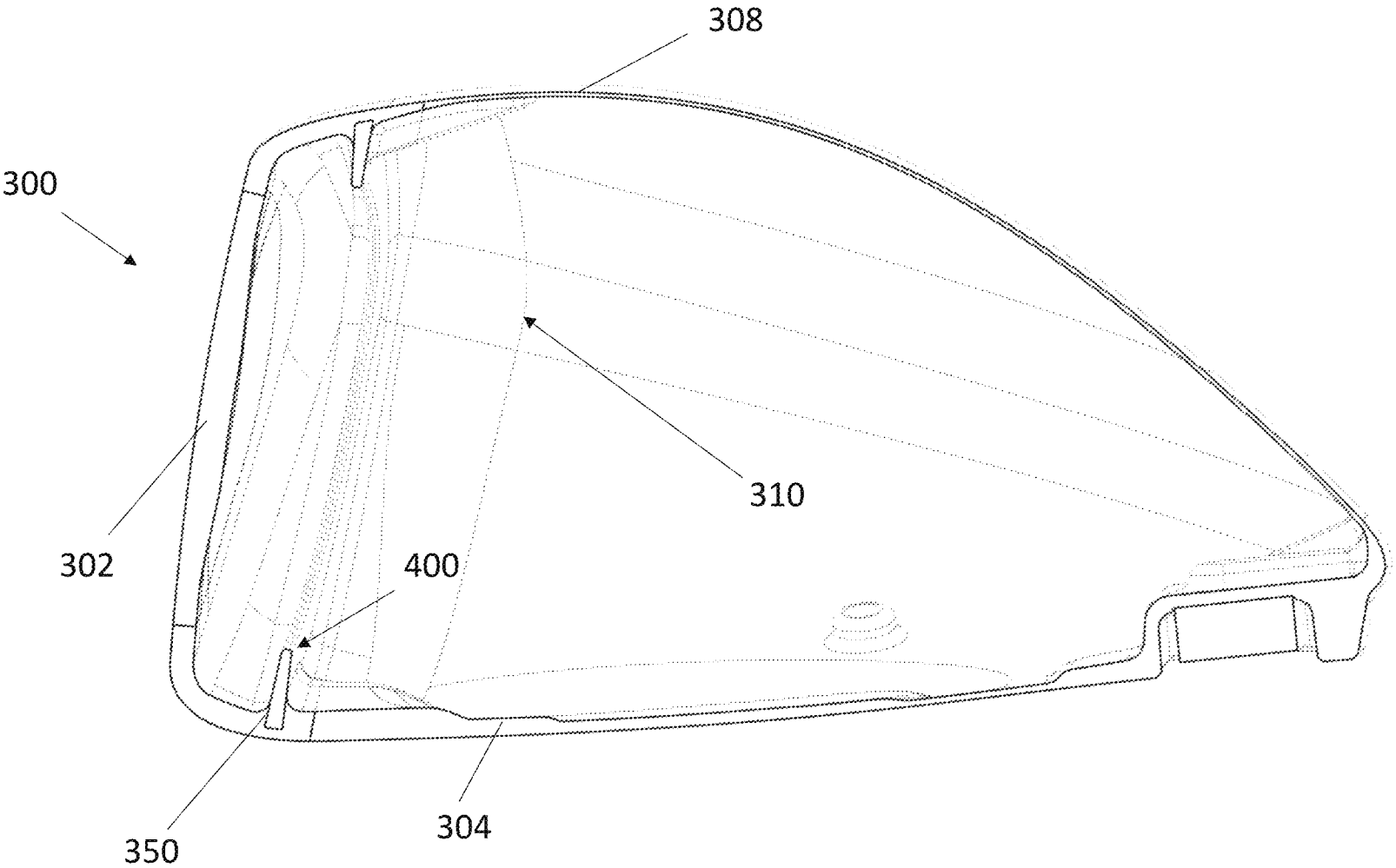
FIG. 8 illustrates a cross sectional view of a gold club head including an additional embodiment of a stiffening member.
Figure 9:
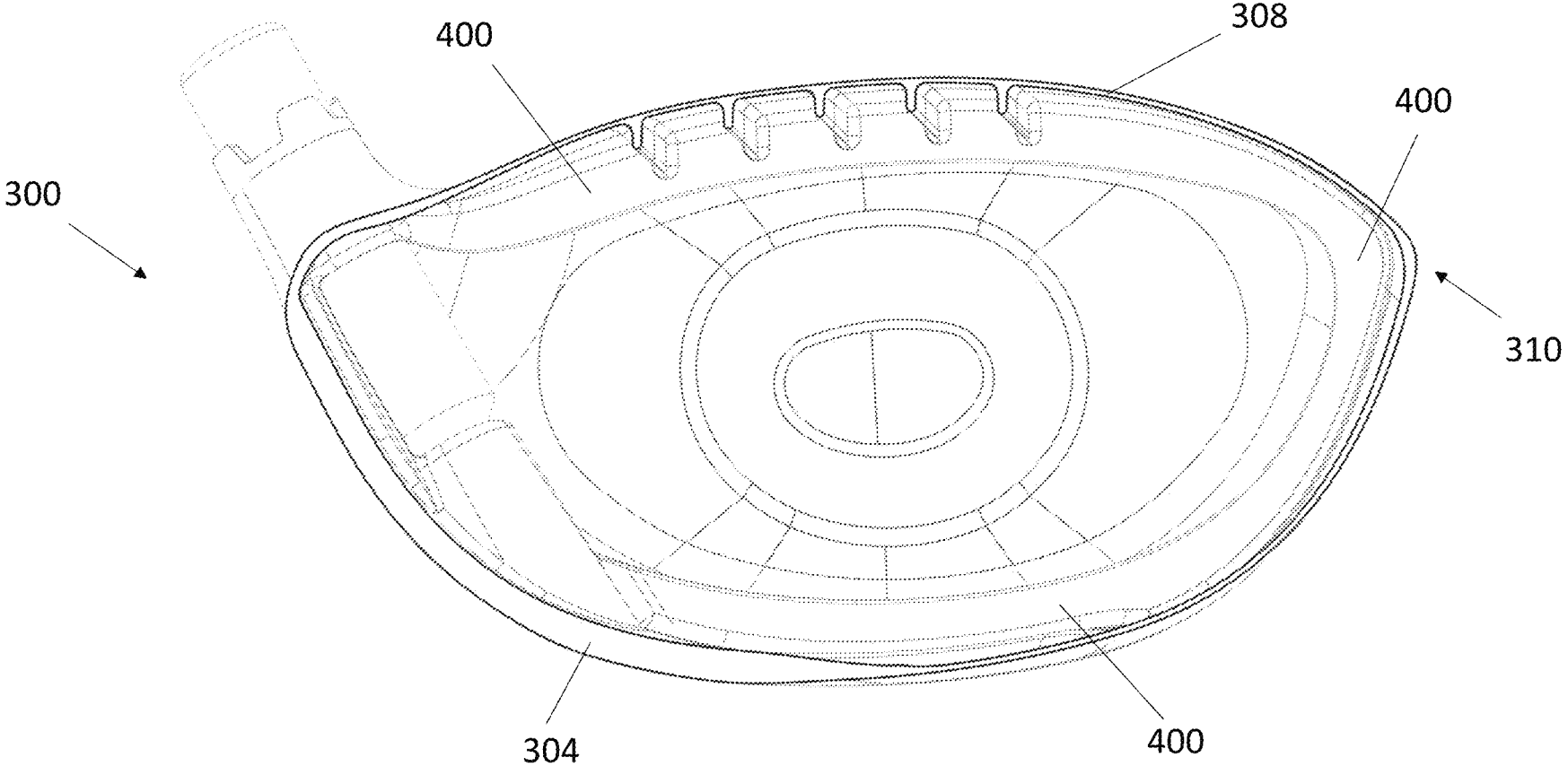
FIG. 9 illustrates an additional cross-sectional view of the golf club head of FIG. 8.

FIG. 8 illustrates a cross sectional view of a gold club head 300 including an additional embodiment of a stiffening member 400. FIG. 9 illustrates an additional cross-sectional view of the golf club head 300 of FIG. 8. The golf club head 300 of FIGS. 8 and 9 include a stiffening member 400 which extends around the golf club head 300 in a loop and is affixed to the sole 304, the skirt 310, and the crown 308. In one embodiment, the stiffening member 400 can be formed in one piece and extending around a majority of the golf club head 300. As illustrated in FIG. 8, the stiffening member 400 can reside within a receptacle 350.

Figure 10:
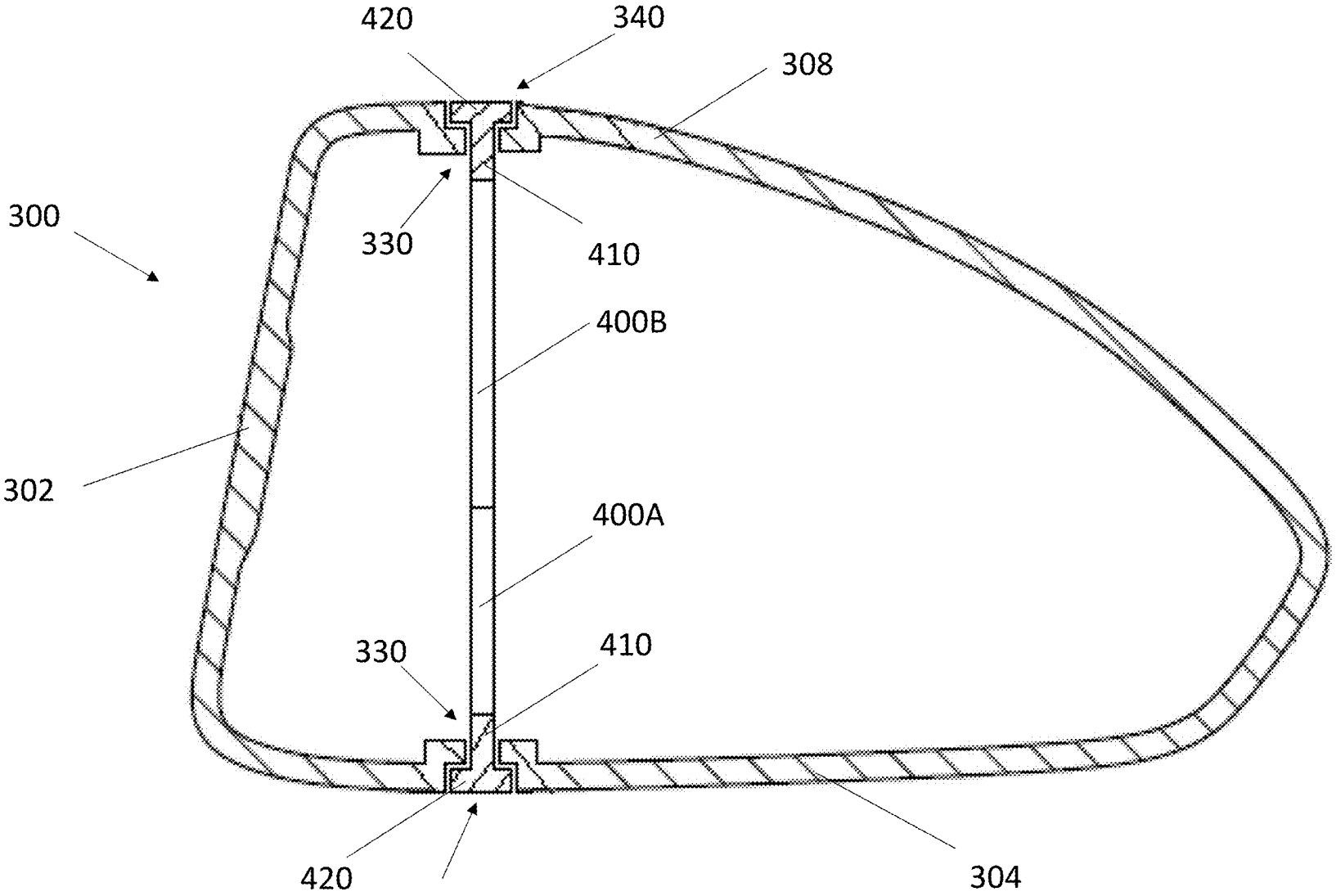
FIG. 10 illustrates an additional embodiment of a golf club head.

FIG. 10 illustrates an additional embodiment of the golf club head 300. The golf club head 300 illustrated in FIG. 10 also includes stiffening members 400A, 400B affixed to both the sole 304 and the crown 308, however rather than one continuous stiffening member, this embodiment includes a first stiffening member 400A and a second stiffening member 400B. Each of these stiffening members 400A, 400B are similar in design to the stiffening member 200 of FIGS. 2-4. The first stiffening member 400A is affixed to the sole 304 and the second stiffening member 400B is affixed to the crown 308. As illustrated, the first stiffening member 400A and the second stiffening member 400B can be arranged parallel to one another such that they are substantially coplanar. The golf club head includes apertures 330 to receive the internal portions 410 of the stiffening members 400A, 400B and recessed portions 340 to receive the external portions 420 of the stiffening members 400A, 400B. In another embodiment the first stiffening member 400A could be affixed to the heel side of both the sole 304 and crown 308 and the second stiffening member 400B could be affixed to the toe side of both the sole 304 and the crown 308.

In some embodiments, golf club heads can include both metallic portions and composite portions. The composite portions may replace portions of the golf club head such as the crown and/or the sole. The composite portions are generally lighter than a metallic portion and allow for more discretionary mass for the golf club head designer to optimize center of gravity properties and moments of inertia. The composite portions can be formed from a variety of materials, which may include for example, pre-preg carbon composite, injection molded carbon composite, traditionally laid carbon composite, thermoplastic carbon composite, thermoset material, injection molded carbon composite, a polymer, polyphenylene sulfide (PPS), a polyether ether ketone (PEEK), a polyamide (PA). The composite portions can be formed from a variety of processes, which may include for example, wet layups, pre-preg layup cured in an autoclave, resin infusion, compression molding, injection molding, thermoforming, etc., or any combination thereof.

In a preferred embodiment, the composite portions are thermoformed thermoplastics which offer superior strength and durability performance as compared with injection molded thermoplastics and chopped fiber constructions allowing for panels to be very thin. One limitation to thermoforming composite portions of the golf club head is that you cannot vary the thickness of the panel. Thus if a feature with height is required on one side of a panel, a corresponding depression on the opposite side of the panel is required. Often, golf club heads with composite portions require stiffening members to improve the acoustic signature of the golf club head, which offers a unique challenge when utilizing thermoformed thermoplastic composite portions. The golf club head 500 described below, which incorporates a metallic body 560 with thermoformed composite panels, offers a unique solution to that challenge.

Figure 11:
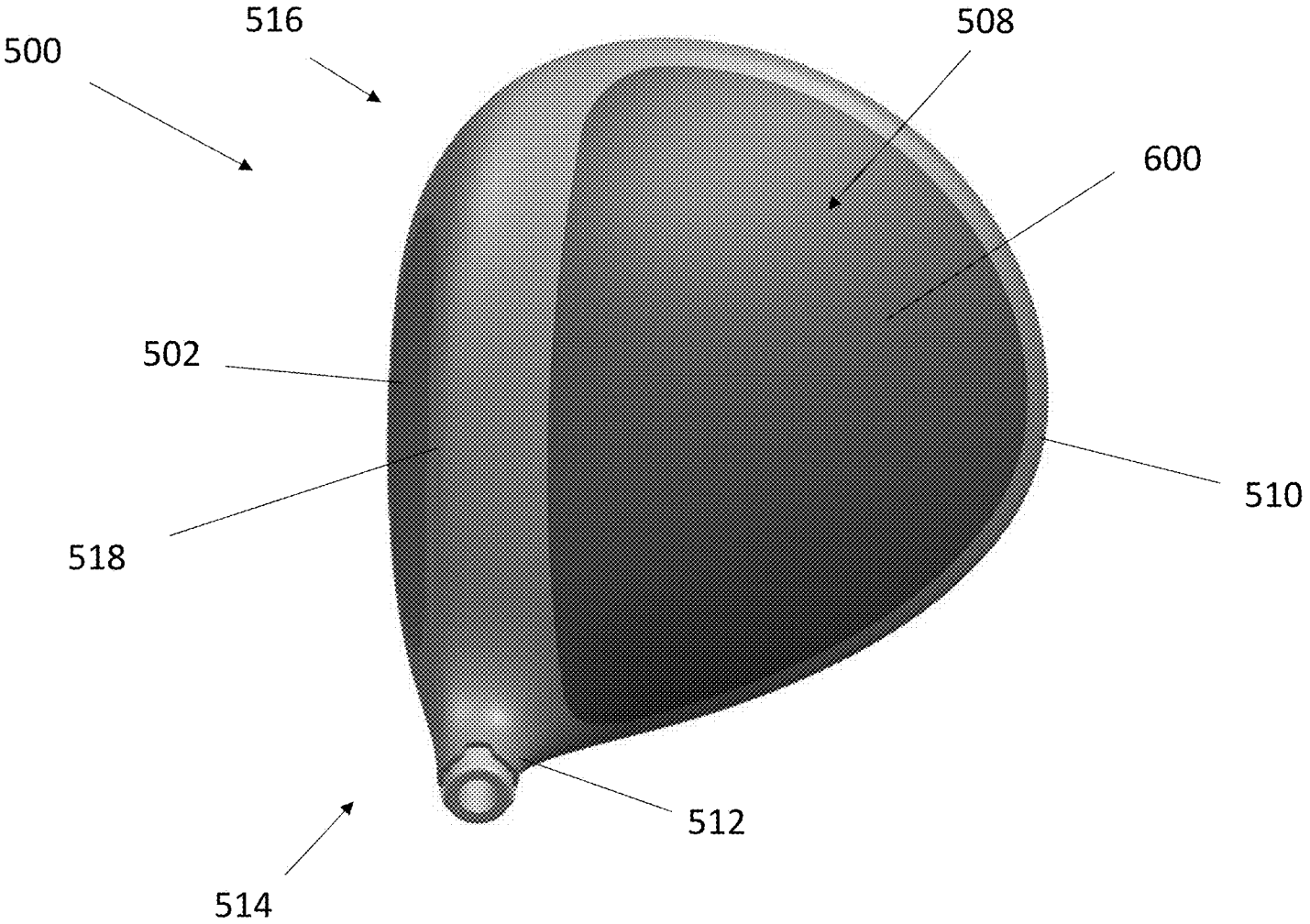
FIG. 11 illustrates a top view of an additional embodiment of a golf club head.
Figure 12:
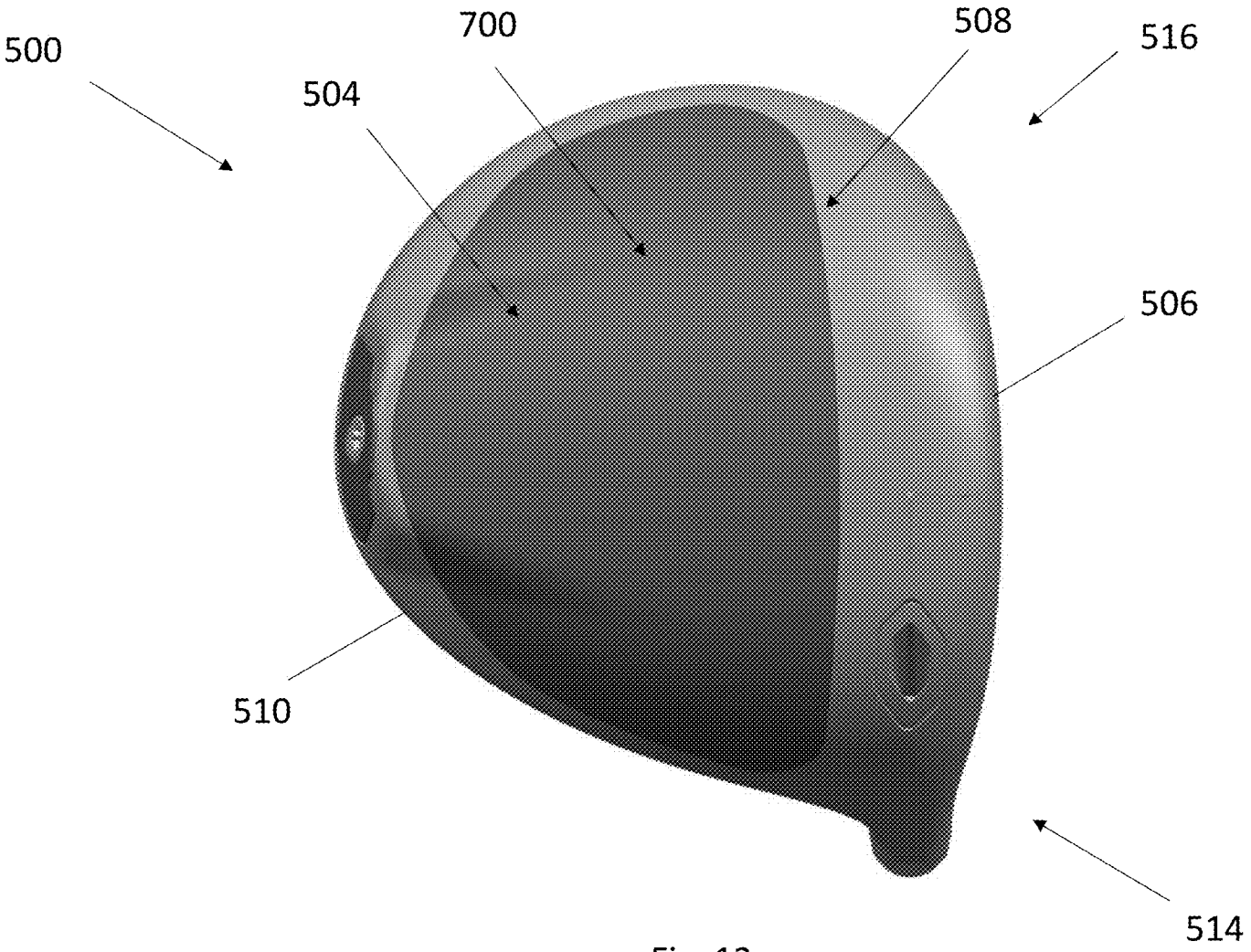
FIG. 12 illustrates a bottom view of the golf club head of FIG. 11.
Figure 13:
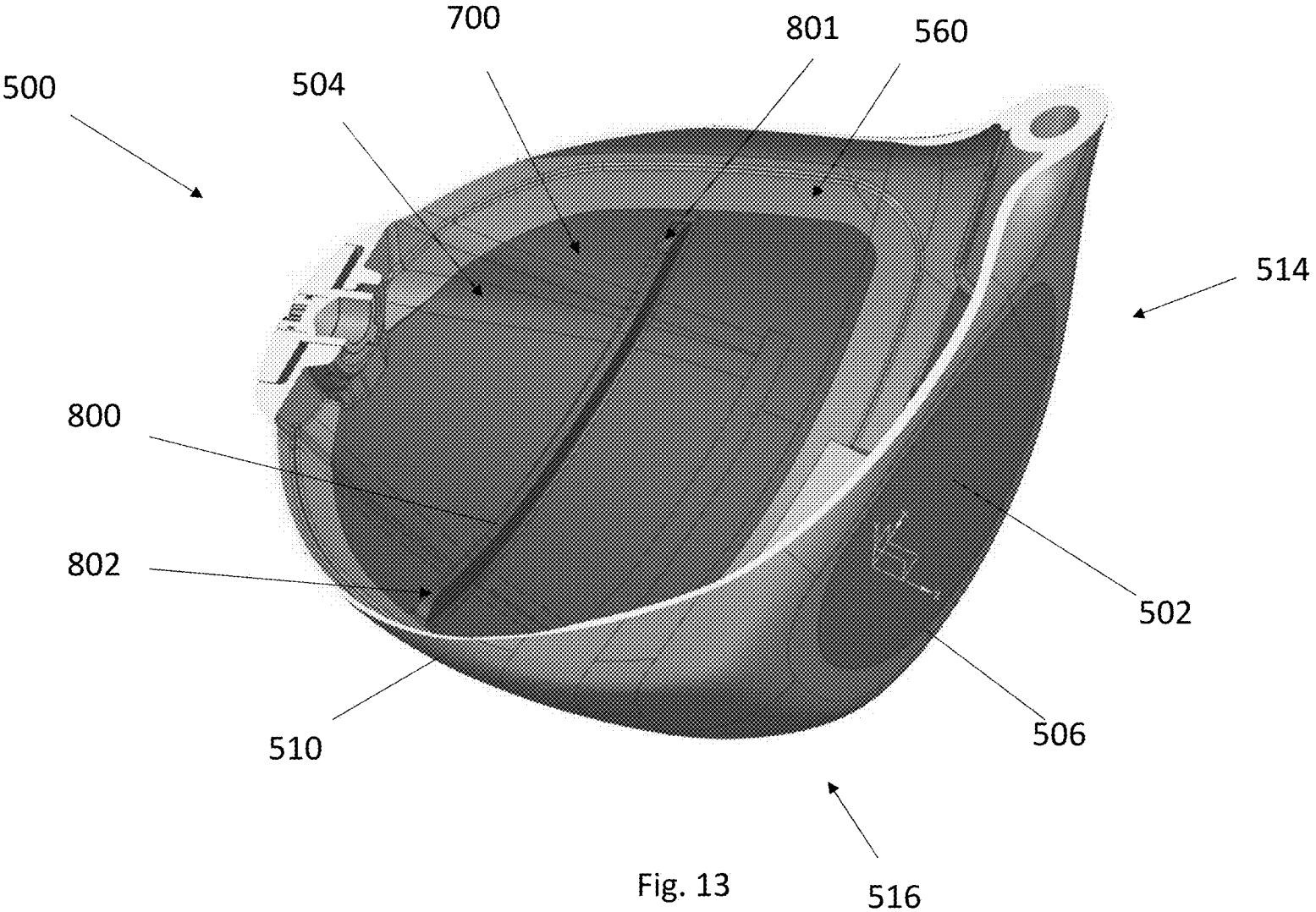
FIG. 13 illustrates a perspective view of a cross-section of the golf club head of FIG. 11.
Figure 14:
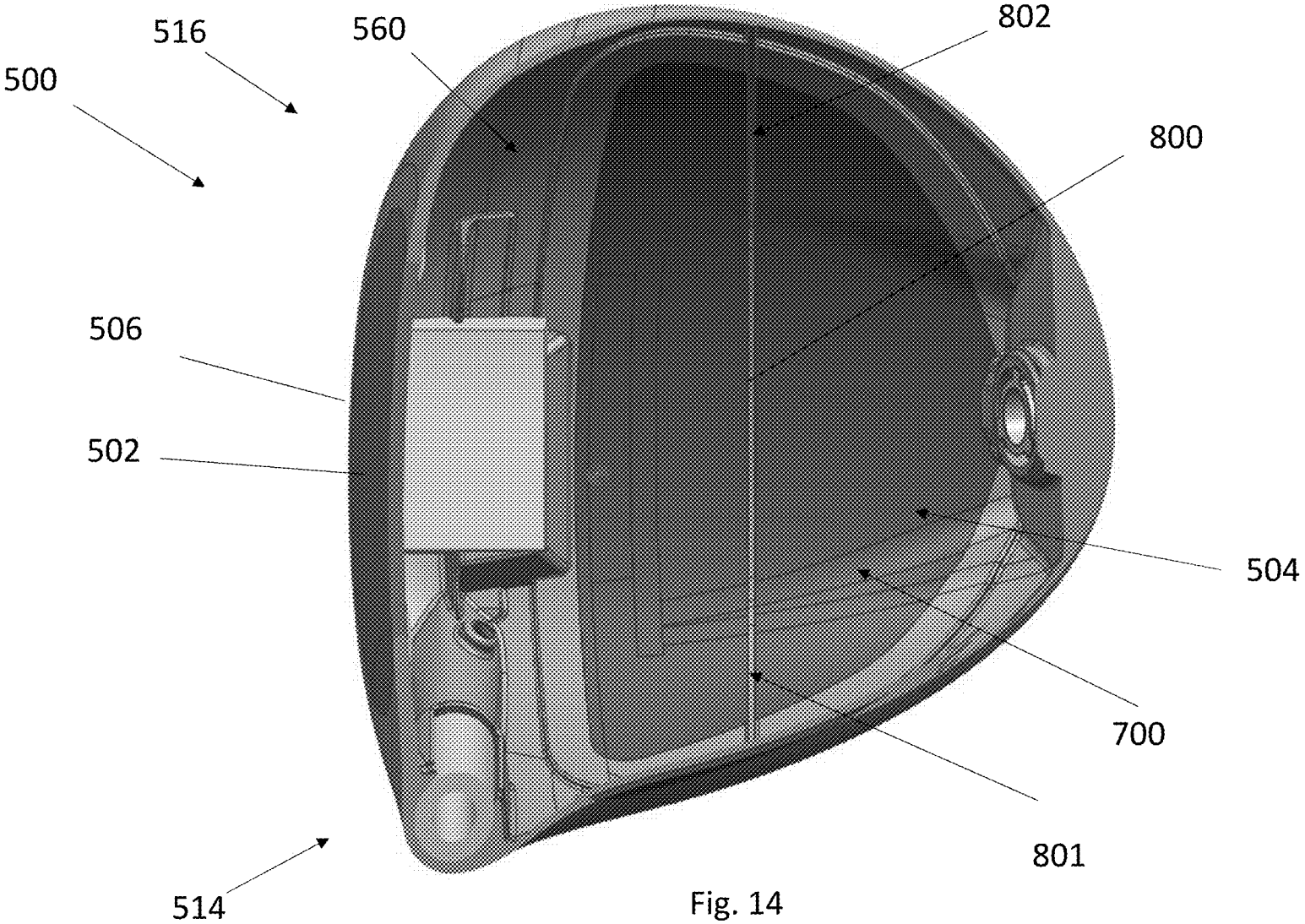
FIG. 14 illustrates a top view of a cross-section of the golf club head of FIG. 11 including an additional embodiment of a composite sole panel.
Figure 15:
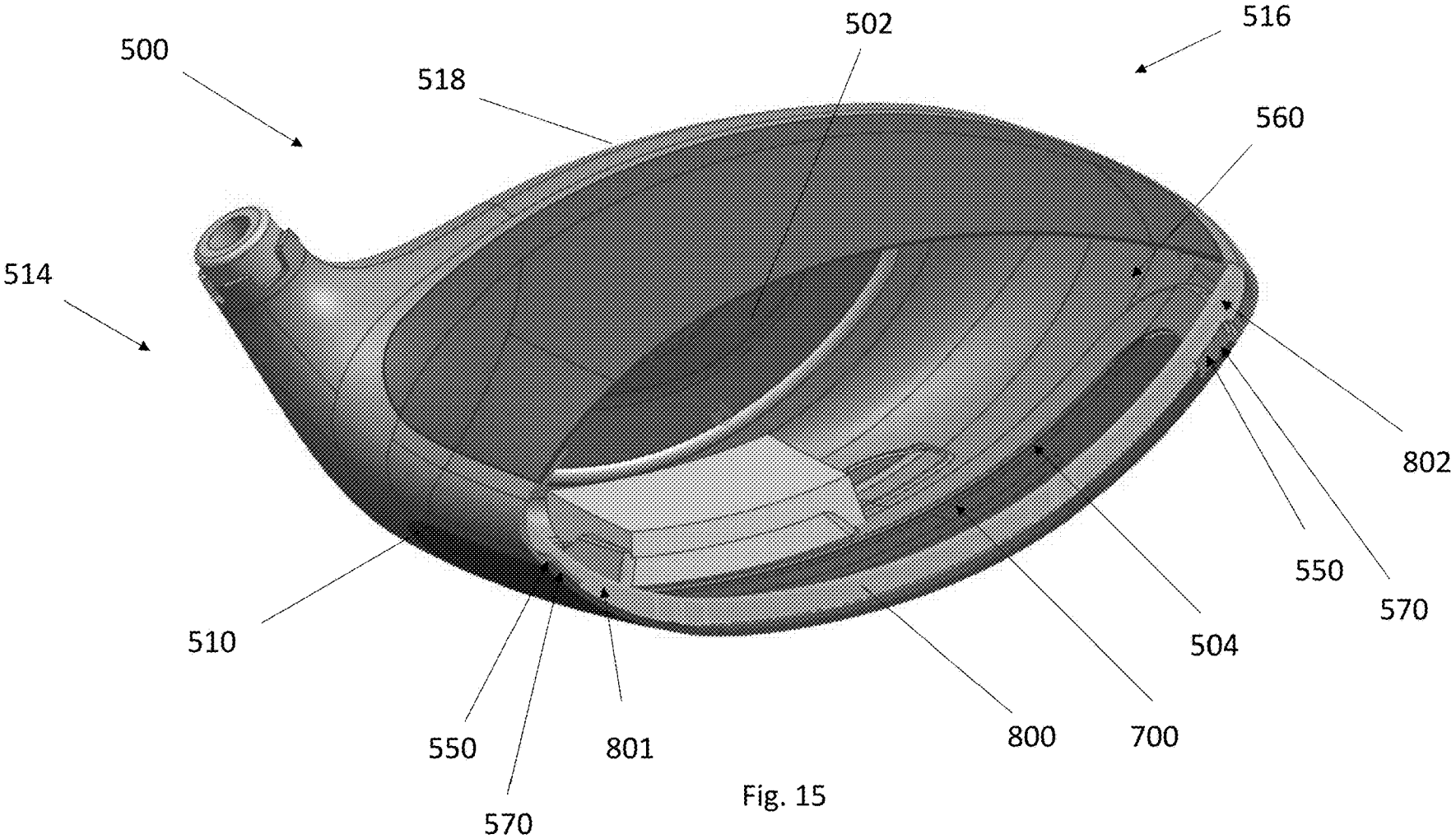
FIG. 15 illustrates a perspective view of a cross-section of the golf club head of FIG. 14.
Figure 16:
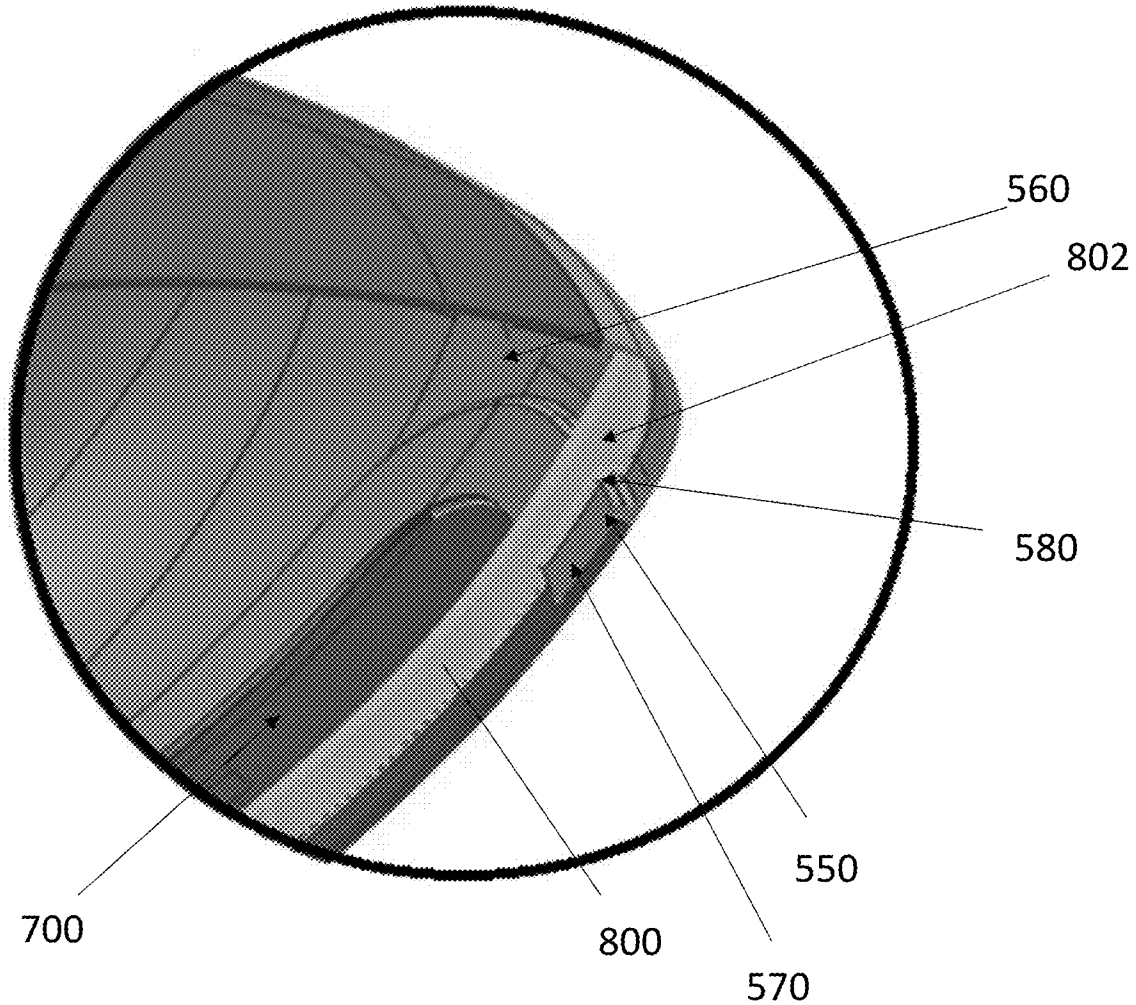
FIG. 16 illustrates a detail view of the interface of the metallic body and the composite sole panel of FIG. 15.

FIGS. 11-16 illustrates a golf club head incorporating a composite crown panel 600 and a composite sole panel 700. FIG. 11 illustrates a top view of an additional embodiment of a golf club head 500. FIG. 12 illustrates a bottom view of the golf club head 500 of FIG. 11. FIG. 13 illustrates a perspective view of a cross-section of the golf club head of FIG. 11. FIG. 14 illustrates a top view of a cross-section of the golf club head 500 of FIG. 11 including an additional embodiment of a composite sole panel 700. FIG. 15 illustrates a perspective view of a cross-section of the golf club head 500 of FIG. 14. FIG. 16 illustrates a detail view of the interface of the metallic body 560 and the composite sole panel 700 of FIG. 15.

As illustrated in FIGS. 11-15 the golf club head 500 includes a striking face 502 at a frontal portion of the golf club head 500, the striking face 502 configured to strike a golf ball (not illustrated). The golf club head also includes a sole 504 extending aft from a lower portion of the striking face 502. The intersection of the striking face 502 and the sole 504 forms the sole return 506. The golf club head 500 also includes a crown 508 extending aft from an upper portion of the striking face 502. The intersection of the striking face 502 and the crown 508 forms the crown return 518. The intersection of the sole 504 and the crown 508 forms a skirt 510 which extends around the aft perimeter of the golf club head 500. The golf club head 500 includes a hosel 512 extending out of the heel portion 514 of the golf club head 500, the hosel configured to receive a shaft (not illustrated), the heel portion being opposite the toe portion 516.

As illustrated in FIG. 11, a majority of the crown 508 is a composite crown panel 600. The golf club head 500 includes a crown aperture configured to receive the composite crown panel 600. As illustrated in FIG. 12 a majority of the sole 504 is a composite sole panel 700. The golf club head 500 includes a sole aperture configured to receive the composite sole panel 700. The metallic portion of the golf club head 500 can be referred to as the metallic body 560. FIG. 16 illustrates how the metallic body 560 of the golf club head 500 can include a shelf 570 configured to accept the composite sole panel 700. The crown 508 can share a similar construction. The composite panels 600, 700 can be adhered to the metallic body of the golf club head 500 in a variety of ways, which may include for example, adhesives, co-molding, compression molding, etc. In another embodiment, the metallic body may include the striking face and a sole return and crown return while the aft body is formed from composite panels.

As illustrated in FIG. 13, the golf club head 500 can include a stiffening member 800 affixed to the composite sole panel 700. In a preferred embodiment, the stiffening member 800 extends substantially parallel to the striking face 502 from a heel portion 514 towards a toe portion 516 of the golf club head 500. The stiffening member 800 includes a first portion 801 extending towards the heel portion 514 and a second portion 802 extending towards the toe portion 516. In other embodiments, the stiffening member 800 may extend fore-aft substantially perpendicularly to the striking face 502. In additional embodiments, the stiffening member 800 may extend obliquely relative to the striking face 502. In additional embodiments, the stiffening member 800 may include curves or bends such that it does not extend in a substantially straight line.

In a preferred embodiment, the composite sole panel 700 is a thermoformed thermoplastic and the stiffening member 800 is affixed to the composite sole panel 700. In one embodiment, the stiffening member 800 is diffusion bonded to the composite sole panel 700. In another embodiment, the stiffening member 800 is compression thermoformed to the composite sole panel 700. The composite sole panel 700 and the stiffening member 800 can be formed from materials which are thermally compatible with one-another. The components may be heated in a variety of techniques which may include, an oven, infrared heating, ultrasonic heating, etc, before they are joined together. In another embodiment, the stiffening member 800 is affixed to the composite sole panel 700 via ultrasonic welding. In another embodiment, the stiffening member 800 is affixed to the composite sole panel 700 with an adhesive. In another embodiment, the stiffening member 800 is can be co-molded to the composite sole panel 700. The stiffening member 800 can be formed from a variety of materials, which may include for example, pre-preg carbon composite, injection molded carbon composite, traditionally laid carbon composite, thermoplastic carbon composite, thermoset material, injection molded carbon composite, a polymer, polyphenylene sulfide (PPS), a polyether ether ketone (PEEK), a polyamide (PA), titanium, steel, aluminum, magnesium, etc. In one embodiment, the composite stiffening member includes continuous carbon fibers running along its entire length. In another embodiment, the stiffening member could be affixed to another composite panel such as the composite crown panel.

As illustrated in FIGS. 14-16, the metallic body 560 of the golf club head 500 can include a shelf 570 configured to accept the composite sole panel 700. The stiffening member 800 can extend past the ends of the composite sole panel 700. In one embodiment the stiffening member 800 can bridge the interface between the composite sole panel 700 and the metallic body 560 of the golf club head 500. In one embodiment, the metallic body 560 of the golf club head 500 can include one or more receptacles 550 extending into the interior of the golf club head 500 configured to receive and retain the stiffening member 800. In some embodiments the stiffening member 800 can be adhered to the metallic body 560. In some embodiments, the stiffening member 800 can be adhered to the receptacles 550. In one embodiment, as illustrated in FIG. 16, the shelf 570 can include a slot 580 in which the stiffening member 800 resides and wherein the shelf 570 acts as a receptacle 550 for the stiffening member 800.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. A golf club head, comprising:

a metallic body comprising:

a striking face, an aft portion extending aft from said striking face;

said aft portion comprising:

a sole defining a lower surface of said golf club head and extending aft from said striking face;

a crown defining an upper surface of said golf club head and extending aft from said striking face;

a skirt extending between said sole and said crown;

a hosel extending from said crown;

an interior cavity defined by said striking face, said sole, said crown, and said skirt;

a composite panel affixed to said metallic body, said composite panel having a substantially constant thickness; and a composite stiffening member affixed to said composite panel, said composite stiffening member extending into said interior cavity;

wherein said composite stiffening member comprises a composite stiffening member length measured along the major axis of said composite stiffening member, a composite stiffening member height measured perpendicularly to said composite stiffening member length and extending into said interior cavity, and a composite stiffening member width measured perpendicularly to said composite stiffening member length and said composite stiffening member height, wherein said composite stiffening member height is at least twice said composite stiffening member width and wherein said composite stiffening member length is at least five times said composite stiffening member height;

wherein said composite panel comprises a thermoplastic composite;

wherein said composite stiffening member comprises continuous carbon fibers running along its entire length.

2. The golf club head of claim 1, wherein said composite stiffening member is affixed to said metallic body.

3. The golf club head of claim 1, wherein said length of said composite stiffening member extends beyond said composite panel and said composite stiffening member is affixed to said metallic body at both a first end of said composite stiffening member and a second end of said composite stiffening member.

4. The golf club head of claim 1, wherein said metallic body comprises a shelf configured to receive said composite panel, and wherein said shelf comprises a shelf aperture, wherein said composite stiffening member resides within said shelf aperture.

5. The golf club head of claim 4, wherein said composite stiffening member is affixed to said metallic body.

6. A method of constructing a golf club head, comprising:

forming a substantially constant thickness composite body panel out of thermoplastic carbon composite;

forming a composite stiffening member comprising a composite stiffening member length measured along the major axis of said composite stiffening member, a composite stiffening member height measured perpendicularly to said composite stiffening member length, and a composite stiffening member width measured perpendicularly to said composite stiffening member length and said composite stiffening member height, wherein said composite stiffening member height is at least twice said composite stiffening member width and wherein said composite stiffening member length is at least five times said composite stiffening member height;

affixing said composite stiffening member to said composite body panel;

affixing said composite body panel to a metallic body;

wherein said metallic body comprises:

a striking face, an aft portion extending aft from said striking face;

said aft portion comprising:

a sole defining a lower surface of said golf club head and extending aft from said striking face;

a crown defining an upper surface of said golf club head and extending aft from said striking face;

a skirt extending between said sole and said crown;

a hosel extending from said crown; and an interior cavity defined by said striking face, said sole, said crown, and said skirt;

wherein forming a composite stiffening member comprises laying continuous carbon fibers along the length of said composite stiffening member.

7. The method of constructing a golf club head of claim 6, further comprising affixing said composite stiffening member to said metallic body.

8. The method of constructing a golf club head of claim 7, wherein said metallic body comprises a shelf configured to receive said composite body panel, wherein said shelf comprises a shelf aperture configured to receive said composite stiffening member, and wherein said method of constructing a golf club head further comprises installing said composite stiffening member into said shelf aperture.

9. The method of constructing a golf club head of claim 7, wherein said composite stiffening member extends beyond said composite panel and said composite stiffening member is affixed to said metallic body at both a first end of said composite stiffening member and a second end of said composite stiffening member.

10. The method of constructing a golf club head of claim 6, wherein affixing said composite stiffening member to said composite body panel comprises diffusion bonding said composite stiffening member to said composite body panel.

11. The method of constructing a golf club head of claim 6, wherein affixing said composite stiffening member to said composite body panel comprises a compression thermoforming process.

12. The method of constructing a golf club head of claim 6, wherein said composite body panel covers an aperture formed in said sole of said metallic body.

13. A method of constructing a golf club head, comprising:

forming a substantially constant thickness composite body panel;

forming a composite stiffening member comprising a composite stiffening member length measured along the major axis of said composite stiffening member, a composite stiffening member height measured perpendicularly to said composite stiffening member length, and a composite stiffening member width measured perpendicularly to said composite stiffening member length and said composite stiffening member height, wherein said composite stiffening member height is at least twice said composite stiffening member width and wherein said composite stiffening member length is at least five times said composite stiffening member height;

affixing said composite stiffening member to said composite body panel;

affixing said composite body panel to a metallic body;

wherein said metallic body comprises:

a striking face, an aft portion extending aft from said striking face;

said aft portion comprising:

a sole defining a lower surface of said golf club head and extending aft from said striking face;

a crown defining an upper surface of said golf club head and extending aft from said striking face;

a skirt extending between said sole and said crown;

a hosel extending from said crown;

an interior cavity defined by said striking face, said sole, said crown, and said skirt; and a shelf configured to receive said composite body panel, wherein said shelf comprises a shelf aperture configured to receive said composite stiffening member;

installing and affixing said composite stiffening member into said shelf aperture;

wherein forming a composite stiffening member comprises laying continuous carbon fibers along the length of said composite stiffening member.

14. The method of constructing a golf club head of claim 13, wherein said composite body panel comprises a thermoplastic carbon composite.

15. The method of constructing a golf club head of claim 13, wherein affixing said composite stiffening member to said composite body panel comprises a diffusion bonding process.

16. The method of constructing a golf club head of claim 13, wherein affixing said composite stiffening member to said composite body panel comprises a compression thermoforming process.

17. The method of constructing a golf club head of claim 13, wherein said composite body panel covers an aperture formed in said sole of said metallic body.

* * * * *